US006791080B2

(12) United States Patent
Doroshenko et al.

(10) Patent No.: US 6,791,080 B2
(45) Date of Patent: Sep. 14, 2004

(54) METHOD AND APPARATUS FOR EFFICIENT TRANSFER OF IONS INTO A MASS SPECTROMETER

(75) Inventors: Vladimir M. Doroshenko, Ellicott City, MD (US); Victor V. Laiko, Columbia, MD (US); Phillip V. Tan, Columbia, MD (US)

(73) Assignee: Science & Engineering Services, Incorporated, Burtonsville, MD (US)

( * ) Notice: Subject to any disclaimer, the term of this patent is extended or adjusted under 35 U.S.C. 154(b) by 0 days.

(21) Appl. No.: 10/367,917

(22) Filed: Feb. 19, 2003

(65) Prior Publication Data

US 2004/0159784 A1 Aug. 19, 2004

(51) Int. Cl.[7] ..... H01J 49/04
(52) U.S. Cl. ..... 250/288; 250/287; 250/286
(58) Field of Search ..... 250/288, 287, 250/286

(56) References Cited

U.S. PATENT DOCUMENTS

| | | | | |
|---|---|---|---|---|
| 4,209,696 A | | 6/1980 | Fite | |
| 4,542,293 A | | 9/1985 | Fenn et al. | |
| 5,306,910 A | * | 4/1994 | Jarrell et al. | 250/286 |
| 5,654,545 A | * | 8/1997 | Holle et al. | 250/287 |
| 5,747,799 A | | 5/1998 | Franzen | |
| 5,965,884 A | * | 10/1999 | Laiko et al. | 250/288 |
| 6,107,628 A | | 8/2000 | Smith et al. | |
| 6,486,469 B1 | * | 11/2002 | Fischer et al. | 250/288 |

OTHER PUBLICATIONS

Electrospray Ionization for Mass Spectrometry of Large Biomolecules, John B. Fenn, et al., Science, vol. 246, Oct. 1989, pp. 64–71.

Recent Developmenmts in Atmospheric Pressure MALDI Mass Spectrometry, Vladimir M. Doroshenko et al., International Journal of Mass Spectrometry, vol. 221, pp. 39–58.

Atmospheric Pressure Matrix–Assisted Laser Desorption/Ionization Mass Spectrometry, Victor V. Laiko et al., Analytical Chemistry, vol. 72, No. 4, Feb. 15, 2000, pp. 652–657.

Atmospheric Pressure MALDI/Ion Trap Mass Spectrometry, Victor V. Laiko et al., Anal. Chem. 2000, vol. 72, pp. 5239–5243.

* cited by examiner

*Primary Examiner*—Jack Berman
(74) *Attorney, Agent, or Firm*—Oblon, Spivak, McClelland, Maier & Neustadt, P.C.

(57) ABSTRACT

An apparatus and a method which produce a pulse of ions, generate a transient electric field correlated in time with a duration of the pulse of ions, receive the pulse of ions into the transient electric field, and collect the ions from an ion drift region of the transient electric field into a gas dynamic flow region of the mass analyzer. As such, an apparatus for transferring ions into a mass analyzer includes an ion source configured to generate the pulse of ions, a transient electric field device configured to receive the pulse of ions and generate the transient electric field, and an ion collector configured to collect the ions from the ion drift region and transfer the ions into the mass analyzer.

70 Claims, 20 Drawing Sheets

1047Da

◆ 1047Da, 2.4kV/mm ■ 1047Da, 2.0kV/mm

1047Da, 1.5kV/mm × 1047Da, 1.0kV/mm

—— 2 PER. MOV. AVG. (1047Da, 2.4kV/mm) – – 2 PER. MOV. AVG. (1047Da, 2.0kV/mm)

·····2 PER. MOV. AVG. (1047Da, 1.5kV/mm) –··– 2 PER. MOV. AVG. (1047Da, 1.0kV/mm)

TIC

● 2.4kV/mm
■ 2.0kV/mm
1.5kV/mm
× 1.0kV/mm
—— 2 PER. MOV. AVG. (2.4kV/mm)
– – 2 PER. MOV. AVG. (2.0kV/mm)
····· 2 PER. MOV. AVG. (1.5kV/mm)
–·– 2 PER. MOV. AVG. (1.0kV/mm)

1534Da

● 2.4kV/mm
■ 2.0kV/mm
1.5kV/mm
× 1.0kV/mm
—— 2 PER. MOV. AVG. (2.4kV/mm)
– – 2 PER. MOV. AVG. (2.0kV/mm)
····· 2 PER. MOV. AVG. (1.5kV/mm)
–·– 2 PER. MOV. AVG. (1.0kV/mm)

TIC: CONICAL ENTRANCE

1534Da: CONICAL ENTRANCE

1047Da: CONICAL ENTRANCE

TIC: CONICAL ENTRANCE

1534Da: CONICAL ENTRANCE

1047Da: CONICAL ENTRANCE

TIC: CONICAL ENTRANCE (20fmol)

1534Da: CONICAL ENTRANCE (20fmol)

1047Da: CONICAL ENTRANCE (20fmol)

METHOD AND APPARATUS FOR EFFICIENT TRANSFER OF IONS INTO A MASS SPECTROMETER

DISCUSSION OF THE BACKGROUND

1. Field of the Invention

This invention relates in general to mass spectrometers, and in particular to pulsed ion sources for mass spectrometers.

2. Background of the Invention

Mass spectrometry is an analytical technique used to measure the mass of ionized chemical species by separating ions according to their mass-to-charge ratios, and detecting ions in an ion detector. Ionization of chemical samples for mass analysis can be accomplished by a variety of methods including for example atmospheric pressure matrix-assisted laser desorption ionization (AP-MALDI), electrospray ionization, atmospheric pressure chemical ionization (APCI), inductively-coupled plasma (ICP) discharge, and photoionization. The generated ions are transmitted through an atmospheric pressure inlet into a lower vacuum region where ion guides direct the ions into a mass detector.

In atmospheric pressure ion sources, ions (or charged species like small liquid droplets as in the case of electrospray ionization) are dispersed once created. Dispersion of the created ions makes efficient sampling of ions from atmospheric pressure sources difficult. Atmospheric pressure inlets are typically a small aperture or capillary of a limited cross section. Consequently, a significant portion of ions that are created are typically unable to pass through the aperture and are lost for mass analysis. Efficient transport of ions through a small aperture or capillary is even more challenging when the ions are generated farther removed from a region directly adjacent to the aperture. For high sensitivity and high throughput mass analysis, it is important to minimize ion losses before the ions reach a mass detector.

One approach for sampling ions from an atmospheric pressure source is to create ions on-axis with a mass spectrometer's sampling aperture/tube. However, this approach requires precise aperture alignment and source positioning. Furthermore, even using precise procedures, the sampling efficiency is generally less than 1 ion in $10^4$. In AP-MALDI, described by Laiko et al. in U.S. Pat. No. 5,965,884 and in Anal. Chem. 2000 (vol. 72, pp. 652–657, vol. 72, pp. 5239–5243), the entire contents of which are incorporated by reference, a laser irradiation pulse is used to create ions. Ions created with AP-MALDI are extracted into an atmospheric pressure inlet of a mass spectrometer with the aid of both a static electric field and the intake gas flow into the mass spectrometer. In an AP-MALDI configuration, positioning of the laser beam directly on-axis with the aperture provides the best sensitivity. However, a significant fraction of ions are still lost to the walls of the mass spectrometer inlet during the on-axis, continuous extraction procedure. U.S. Pat. No. 4,209,696, the entire contents of which are incorporated by reference, describes combining electrospray ionization sources with pinhole apertures which is yet another example of inefficient ion sampling requiring high precision aperture alignment and source placement.

Still another approach has been to focus ions into a sampling aperture as described in Smith et al. U.S. Pat. No. 6,107,628, the entire contents of which are incorporated by reference. Smith et al. describe an ion funnel that consists of a series of elements of decreasing size. Radio frequency (RF) voltages are applied to alternating elements to direct ions. Franzen, (U.S. Pat. No. 5,747,799), the entire contents of which are incorporated by reference, describe focusing with a plate lens placed in front of an aperture plate. Fenn et al., (U.S. Pat. No. 4,542,293), the entire contents of which are incorporated by reference, describe focusing with a plate lens placed in front of a capillary. In addition, mass spectrometer entrances have utilized conical skimmer apertures to improve ion collection efficiency over planar apertures. But this approach is limited by the acceptance angle of the static electric field generated by the cone. In addition, source position is once again critical to performance.

All these focusing devices are inherently complex, position dependent, and not efficient. Consequently there exists a need for a device to increase the ion sampling efficiency of ion sources.

SUMMARY OF THE INVENTION

One object of the present invention is to increase the sensitivity and detection limits of an ionic species generated external to a mass spectrometer.

A further object of this invention is to increase ion transmission through an atmospheric pressure inlet of a mass spectrometer.

Still, a further object is to provide a technique by which laser spot alignment with an axis of a mass analyzer is not critical to ion collection.

Yet, another object is to provide ion collection from laser-irradiated areas larger than an aperture diameter entrance of a mass analyzer.

These and other objects are accomplished, according to the present invention, in an apparatus and a method which produce a pulse of ions, generate a transient electric field correlated in time with a duration of the pulse of ions, receive the pulse of ions into the transient electric field, and collect the ions from an ion drift region of the transient electric field into a gas dynamic flow region of the mass analyzer. As such, an apparatus for transferring ions into a mass analyzer includes an ion source configured to generate the pulse of ions, a transient electric field device configured to receive the pulse of ions and generate the transient electric field, and an ion collector configured to collect the ions from the ion drift region and transfer the ions into the mass analyzer.

In one aspect of the present invention, the apparatus includes an AP-MALDI ion source, switching circuitry, and a timing device which creates a transient high-voltage (HV) extraction field. Ions in an AP-MALDI ion source are generated by a pulsed laser. The laser pulse is generated prior to the onset of a transient high-voltage extraction field. According to the present invention, the transient high-voltage extraction field is maintained for a set time interval after the laser pulse and then removed thereafter. The result of which is an increased transmission of ions into the mass analyzer inlet. Because the HV extraction field is no longer static and continuous, but rather applied for a limited initial time period after the pulse of ions is formed, the term "timed-extraction" is used herein to describe a number of ways in which the transient high-voltage extraction field is utilized in relation to pulse ion generation.

In conventional ion collection, ions drift in the applied static electric field from the target to the MS instrument entrance orifice. As a result, some of the ions from the ion source reach the orifice and are then delivered to a mass analyzer region, but many of the ions impact the metal areas surrounding the entrance to the mass analyzer (typically a capillary or a cone wall) and are neutralized and lost from the mass analysis.

In the present invention, the static electric field used conventionally is replaced by a transient electric field which, for example can be applied after generation of a pulse of ions. Ions drift in the transient electric field toward the entrance of the mass analyzer. At a moment, prior to reaching the entrance, the transient electric field is terminated or at least reduced. Since the drift velocity of ions due to the electric field is directly proportional to the electric field strength, the ions do not impact the walls as severely as would occur if the electric field continued to exist. Further, the motion of the ions after termination of the transient electric field is governed by gas dynamics of the gas flow entering the mass analyzer (i.e. a gas dynamic flow region of the mass analyzer) which dominates transport mechanisms in the vicinity of the entrance to the mass analyzer, especially in the absence of an electric field. As a result, ions are not lost on the wall and more ions are entrained in the gas flow of the gas dynamic region and collected into the mass analyzer. Thus, the "turning off" of the field after ions arrive in a region where the gas dynamic flow is substantial results in alleviating the loss of ions from the gas phase due to impact of the ions on the metal walls and neutralization.

One feature of the present invention is that it not only allows ions directly on axis with the mass spectrometer inlet to be analyzed, but by permitting ion drifting in the transient electric field also increases the collection efficiency for ions generated off-axis. This feature, according to the present invention, accommodates laser position fluctuations in atmospheric pressure ion sources such as MALDI without degradation of ion transmission into the mass analyzer. Furthermore, this feature, according to the present invention, allows different laser positions, sizes and energies, along with different target plate-to-MS inlet configurations to be used advantageously to improve ion throughput.

BRIEF DESCRIPTION OF THE DRAWINGS

A more complete appreciation of the present invention and many attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
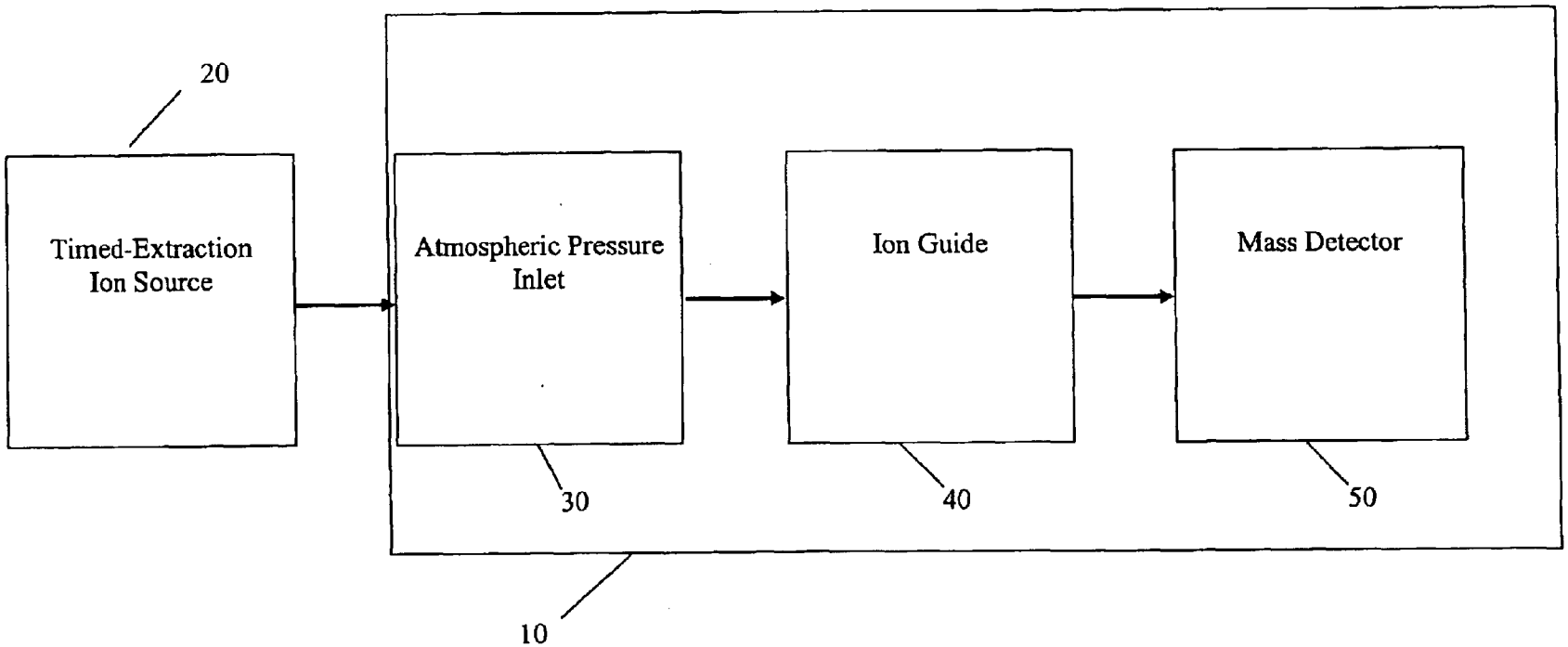
FIG. 1 is a block diagram of one embodiment of the present invention.

Referring now to the drawings, wherein like reference numerals designate identical, or corresponding parts throughout the several views, and more particularly to FIG. 1 thereof, FIG. 1 is a block diagram depicting an apparatus of the present invention for transferring ions into a mass analyzer 10. An ion source generates a pulse of ions for mass analysis. The apparatus of the present invention includes a transient electric field device configured to receive the pulse of ions and generate a transient electric field correlated in time with a duration of the pulse of the ions from the ion source. The transient electric field device is typified in FIG. 1 as timed extraction ion source 20. Ions drift in an ion drift region to the entrance of the mass analyzer 10. The ions enter mass analyzer 10 in a gas dynamic flow region of an ion collector. The ion collector is typified in FIG. 1 as an atmospheric pressure inlet 30. As used herein, "ions" refer to any ionic species included but not limited to ionized atoms, ionized molecules, singly ionized species, doubly ionized species, and higher ionized species, small charged droplets, and other charged species in which a charge has been chemically attached. Once inside the mass analyzer 10, ions are directed along an ion guide 40 into a mass detector 50 configured to analyze a mass/charge ratio.

Figure 2:
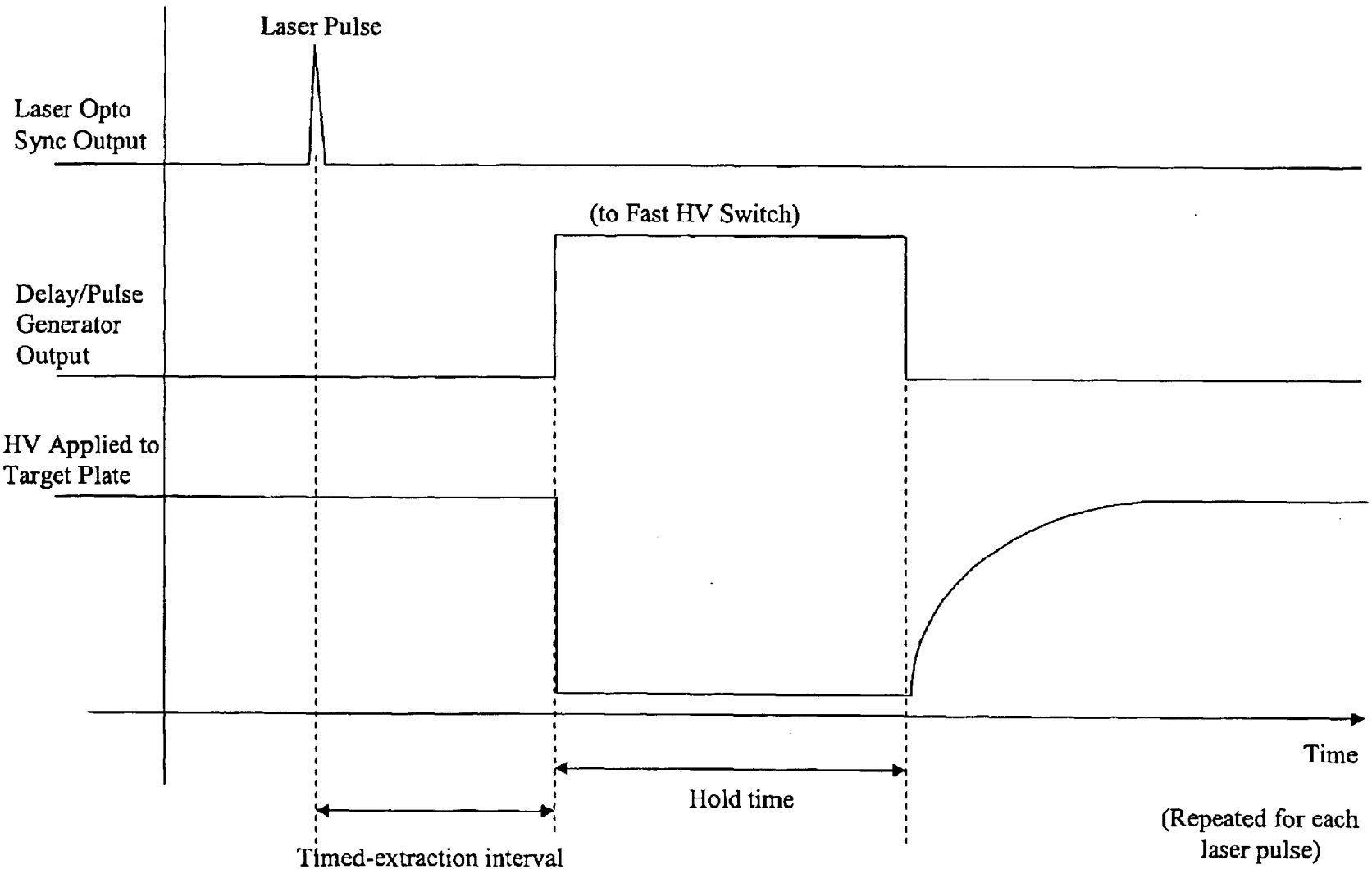
FIG. 2 is a timing diagram illustrating one aspect of the present invention.

As previously noted, a time varying or transient electric field, according to the present invention, improves ion collection. FIG. 2 is a timing diagram illustrating this aspect of the present invention. In this illustration, each laser pulse from an AP-MALDI ion source triggers a delay/pulse generator that sets appropriate times for application of a HV extraction field. Thus, in contrast to continuous extraction, a timed-extraction is used. The time duration between the laser pulse and the instant when the HV extraction field is rapidly lowered to near or at ground potential is termed the "timed-extraction interval". The time duration in which the HV extraction field is absent is termed the "hold time". The hold time can be set to less than a time between laser pulses, allowing the circuitry to return the HV back to the target plate and initialize for the next laser pulse. In one preferred embodiment of the present invention, the hold time is in a range of 0.2 to 10 ms, allowing ions adequate time to drift to the entrance.

Figure 3:
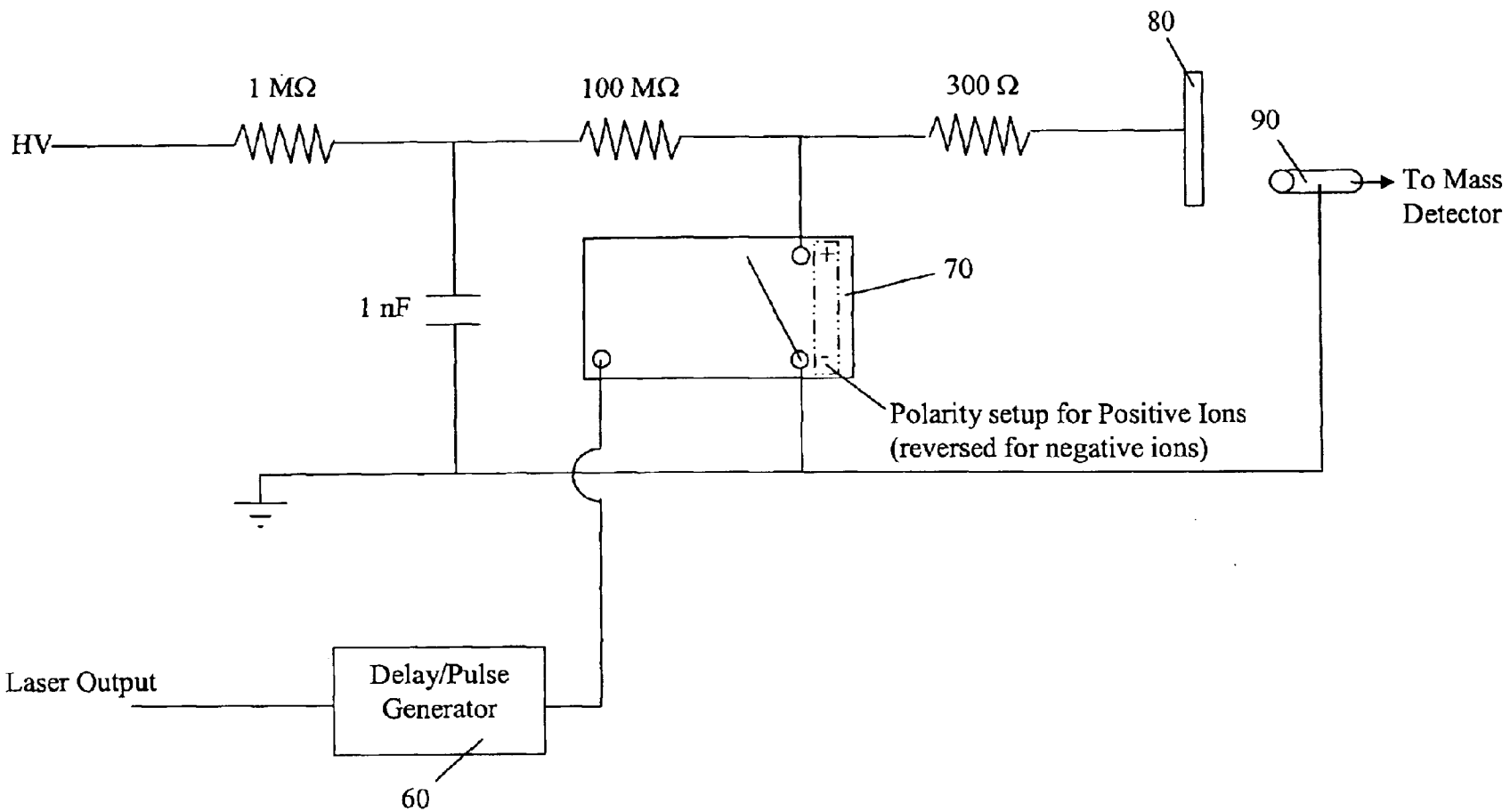
FIG. 3 is an illustrative circuit diagram employed in the present invention to produce a transient HV electric field used to extract ions.

FIG. 3 is an illustrative circuit diagram of a circuit employed in the present invention to apply the transient HV electric field used to extract ions. In this illustrative circuit, HV-compatible resistors (e.g. Model SGP, EBG LLC resistors) compatible with the mass spectrometer's internal resistance are used to allow a target plate 80 to hold a desired HV potential. Laser output from for example a laser of the APMALDI apparatus is used to trigger a delay/pulse generator 60 (e.g., Model DG535, Stanford Research Systems, Inc.) that activates a fast HV transistor switch 70 (e.g., HTS121, Behlke Electronic GmBH) at a set period of time after the laser pulse. Once the fast HV transistor switch 70 is activated, HV is immediately short circuited to ground for a given hold time. After the hold time, the 100 MOhm resistor and the load capacitance (i.e. capacitance of target plate 80) dictate the rise time of the HV back to its initial level. The rise time for the illustrative circuit of FIG. 3 is ~4 ms. The rise time, in this embodiment, is designed to be less than the time between laser pulses for a 10 Hz laser, but may be adjusted in accordance with the present invention to suit different laser repetition rates or different ion pulse rates.

Figure 4A:
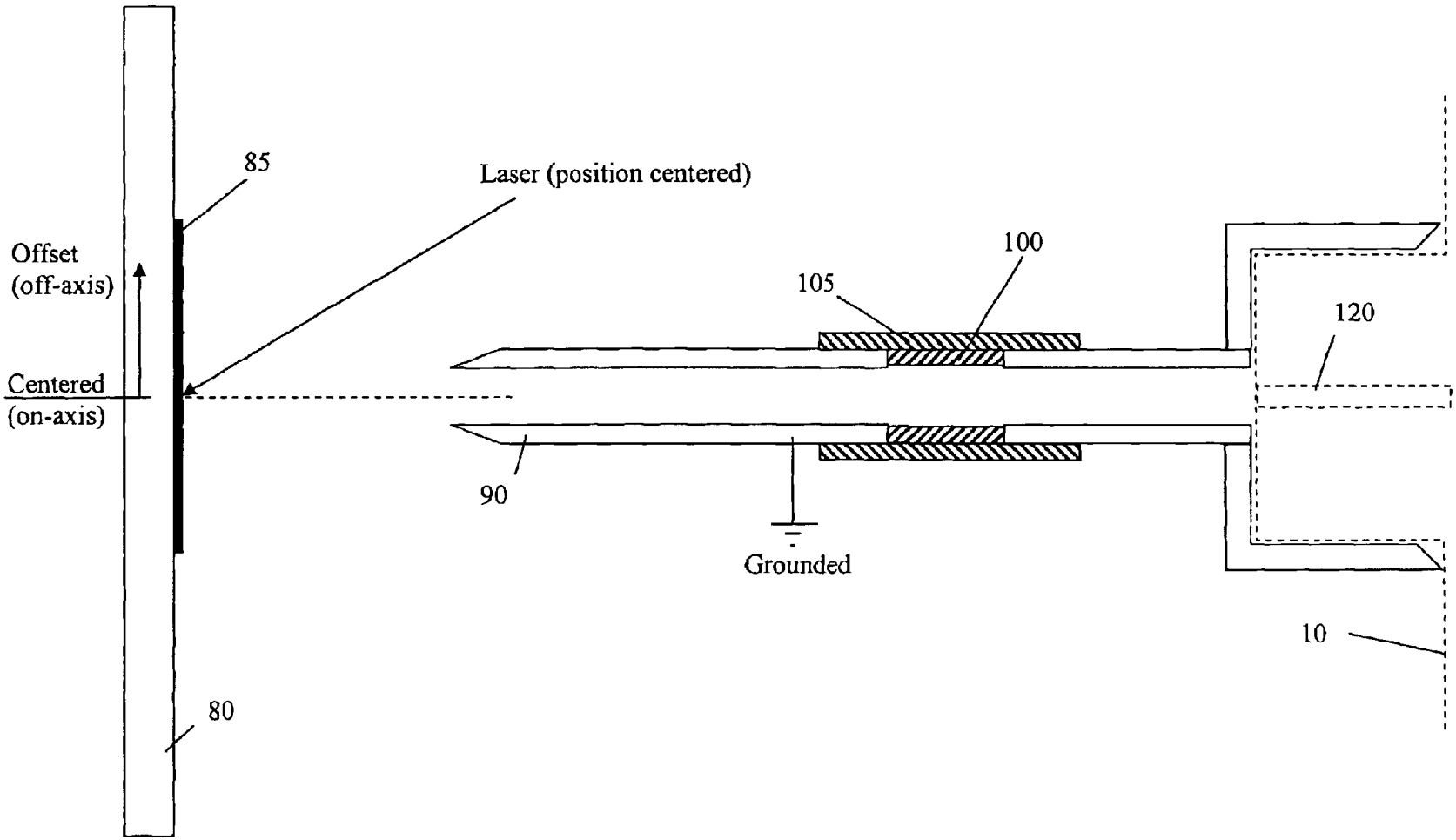
FIG. 4A is a schematic of one embodiment of the present invention depicting an extended capillary electrically isolated from a mass analyzer.
Figure 4B:
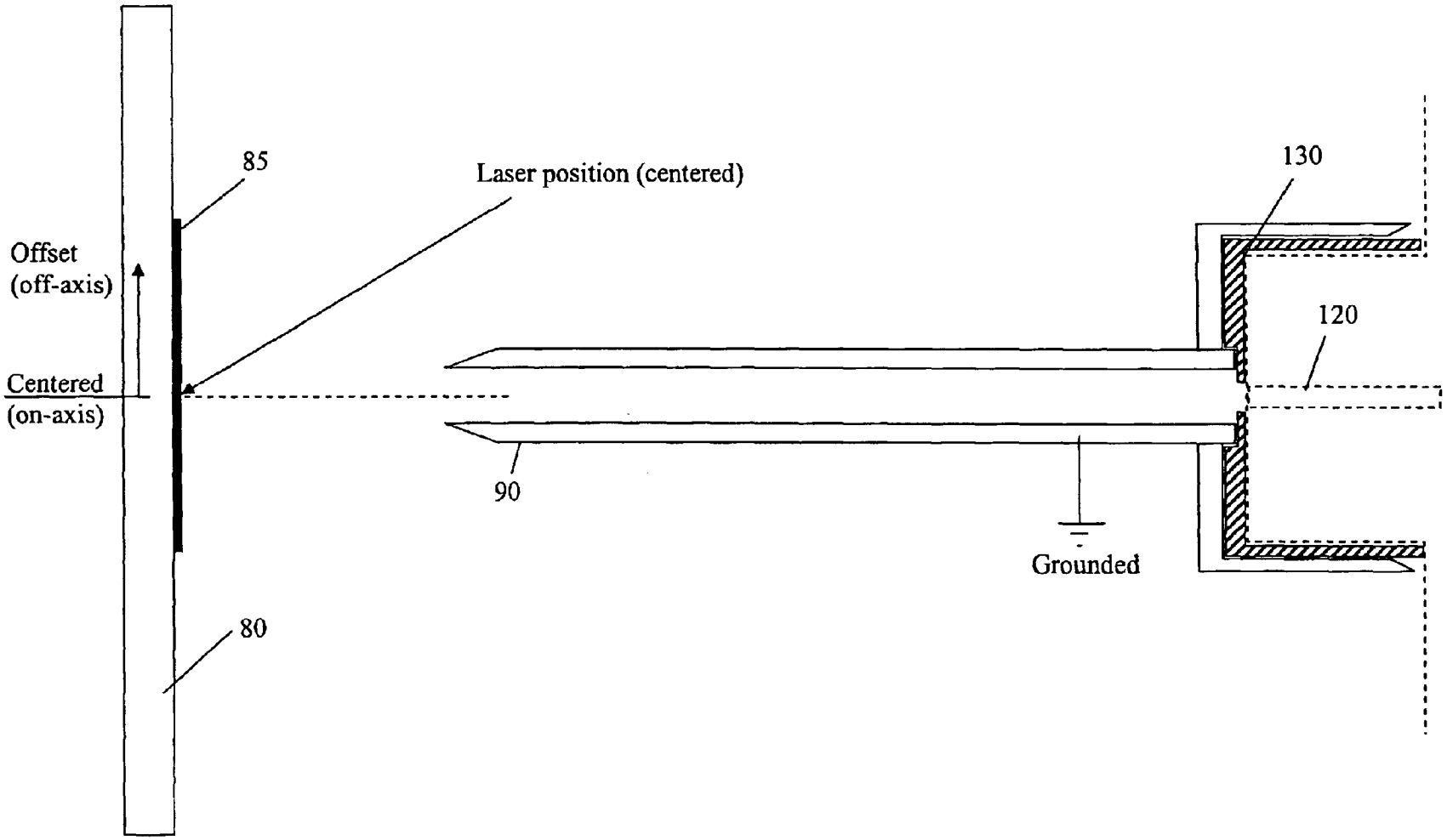
FIG. 4B is a schematic of one embodiment of the present invention depicting an insulating cap on a mass spectrometer inlet.

FIG. 4A is a schematic of a preferred embodiment of the present invention. FIG. 4 depicts an extended capillary ion source 90 (e.g., Model AP/MALDI-110, MassTech Inc.) electrically isolated from the mass analyzer 10 (e.g. a quadrupole ion-trap mass spectrometer—QIT-MS such as for example a LCQ Classic model, Thermo Finnigan Corp.). To protect the mass analyzer 10 from possible arcing from the high voltage on target plate 80, the mass analyzer 10 is electrically isolated using for example an insulating spacer tube 100 made from an appropriate material such as for example Teflon, glass, or an organic polymer along a portion of the capillary length. As shown in FIG. 4A, a support tube 105 can be used to position the spacer tube 100 on the capillary 90. An alternative way to isolate the mass analyzer 10 from the target plate 80 HV would be to use an insulating cap 130 around the mass analyzer 110 inlet, as illustrated in FIG. 4B. Regardless, electrical isolation allows the capillary 90 to be grounded or floated at a desirable potential. In tests using a 8 kV potential on the target plate at a 2 mm distance between the target plate 80 and an electrically-isolated capillary 90, arcing occurred, but occurred without damage or stalling the operation of the mass analyzer 10.

With the timed-extraction circuitry and the electrical isolation described in FIGS. 3, 4A, and 4B, various timed-extraction intervals have been tested at different HV extraction fields to determine the effect of the present invention. For these tests, an extended capillary 90 of nominal inside diameter of 0.825 mm, a length of separation from the mass spectrometer inlet port of 6.6 cm, an inserted Teflon spacer of an axial length of 0.127 cm, and a separation distance from a tip of the capillary 90 to the target plate 80 of 2.0 mm were used. Continuous extraction and timed-extraction were compared by alternating between long timed-extraction intervals of greater than 1 ms and short timed-extraction intervals typically less than 100 $\mu$s, respectively. Approximating continuous extraction with a long timed-extraction interval was justified in that results demonstrated no significant differences between using a timed-extraction interval greater than 1 ms and using a setup applying an actual continuous extraction field. This is logical because for intervals greater than 1 ms after the laser pulse, ions are no longer present in the source to be affected by electric field changes.

Furthermore, according to the present invention, switching from a first electric field potential that is held during the timed-extraction interval, and a second, e.g., a lower, electric field potential that is held during the "hold-time" improves the transfer and collection of ions. For example, in the present invention, switching between a first electric field potential in a range of 1 to 5 kV/mm and then to a second electric field potential can be used. The DC level may be applied to the target plate. Alternatively, a mass spectrometer entrance may be biased to create the necessary transient electric field.

Pulsed ionization techniques which may not be as rapid as laser-based ionization methods such as MALDI can also be used according to the present invention. Pulse ionization methods can take a range of milliseconds for ion formation. Application of the present invention to these pulse ionization techniques adjusts the timed-extraction interval to accommodate the longer ionization times. Thus, the fall time of the electric field from one electric field potential to another is adjusted, according to the present invention, to improve ion collection. Furthermore, switching from one electric field potential to another can be synchronized with the ending or beginning of ion formation. Moreover, a time-varying waveform for the electric field potentials can be used to suit the characteristics of the particular ionization process used. Similarly, the hold-time electric field potentials can also be time-varying, according to the present invention.

Likewise, the duration of the timed-extraction interval and the fall time can be shortened should faster ion drifting techniques other than those used in MALDI be applied. Advantageously, if ions are formed over a longer period of time, the present invention can advantageously switch the electric field potentials before all the ions are formed to improve ion collection. Thus, the present invention is applicable to a variety of pulsed ionization sources.

Modeling of electric field potential lines for the arrangement depicted in FIG. 4A shows electric forces directed from the target plate to walls of inlet and to the tip of the inlet. An electrostatic "funnel" distribution could be used in the present invention. The combination of the transient electric field practice of the present invention with techniques like the ion funnel, described in the above-noted Smith et al. reference, are within the scope of the present invention.

In demonstration of the advantages of the present invention, samples were prepared on standard AP/MALDI target plates using a standard mixture of 5 peptides (e.g., MS-CAL2 ProteoMass Peptide MALDI-MS Calibration Kit, Sigma) at a 200 fmol level with an alpha-cyanno-4-hydroxycinnamic acid (CHCA) matrix. Each sample was spotted with 2 $\mu$L of peptide-matrix solution (peptides were at a concentration of 100 fmol/$\mu$L each) and operated with AP/MALDI's spiral motion option with a 5 mm/min spiral velocity. The prepared samples were placed as sample 85 on target plate 80 as shown in FIG. 4A. AP-MALDI was used to generate a stable ion signal.

Figure 5A:
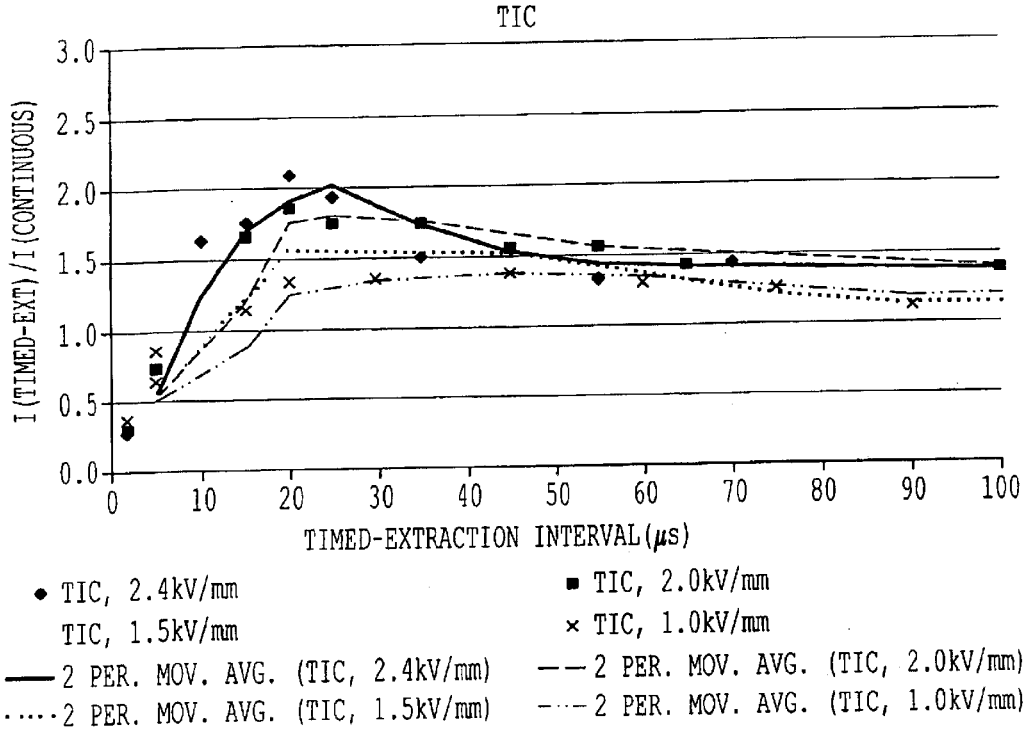
FIGS. 5A–C are graphs depicting the improvement in ion signal intensity with the present invention as compared to a continuous extraction field.
Figure 5B:
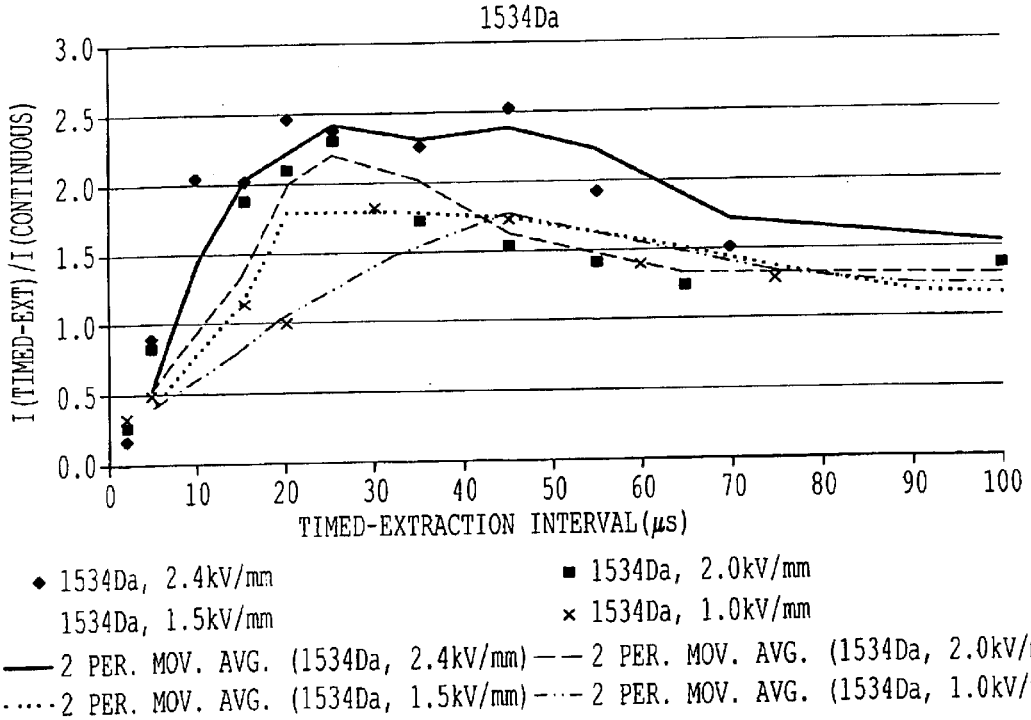
Figure 5C:
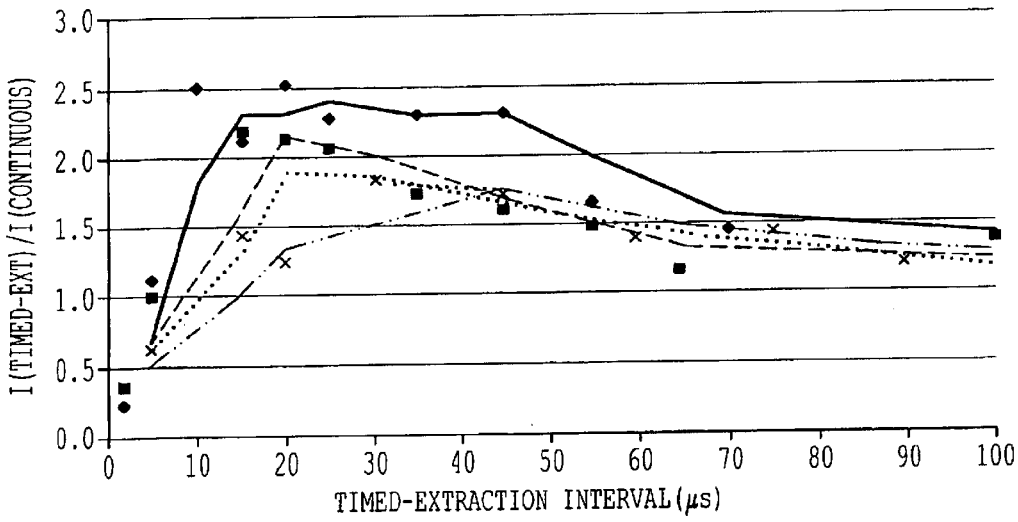

Results comparing timed-extraction with continuous extraction showed an improvement in relative ion intensity using the timed extraction of the present invention and a sensitivity gain by a factor of more than 2 (e.g., FIG. 5A). Total ion current (TIC) comparisons (e.g., FIG. 5A) show that timed-extraction intervals of 20 to 25 $\mu$s, when applying an extraction field of 2.4 kV/mm, yielded optimum improvements for the conditions tested. There was observed an improvement for specific peptide peaks (1534 Da: FIG. 5B; 1047Da: FIG. 5C) of more than 2.5 times using the timed-extraction of the present invention.

As noted previously, the improvements provided by the present invention are likely the result of removing the electric forces attracting ions toward the capillary entrance prior to the ions impinging on the walls of the capillary and being neutralized. The best results in FIGS. 5A–C are found utilizing a time interval in which the electric field is removed just before the ions reach the capillary entrance and at the same time when the ions are close enough to the entrance that airflow can transport the ions the remainder of the distance into the capillary. If the timed-extraction interval is too short, the electric force required to transfer the ions to the airflow region is not adequate, and fewer ions are detected. When the timed-extraction interval is longer, the results approach the continuous extraction performance. The data also indicate that as the HV extraction field is lowered, the optimal timed-extraction interval is increased. Thus, consistency is seen between the above-noted explanation of the higher collection efficiency and the observed results in that to transfer an ion to the intake airflow region, either a strong electric force for a short period of time, or a weaker electric force for a longer period of time would be required. The results also show that, in general, the higher the electric field strength, the higher the improvement level possible. At even higher electric field strengths, there may be further improvements; however, effects such as corona discharge and arcing may influence ion collection.

Figure 6A:
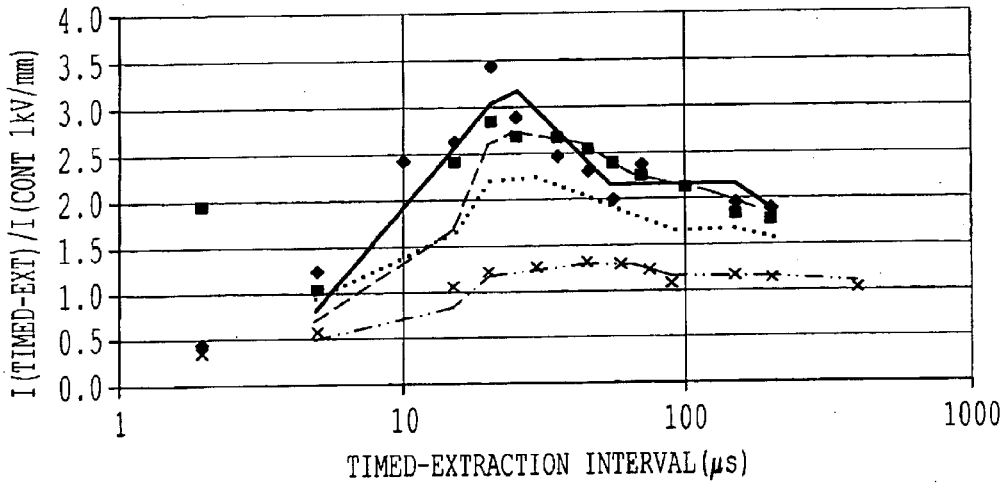
FIGS. 6A–C are graphs depicting the improvement in ion signal intensity with the present invention as compared to a continuous extraction field operated at a typical 1 kV/mm.
Figure 6B:
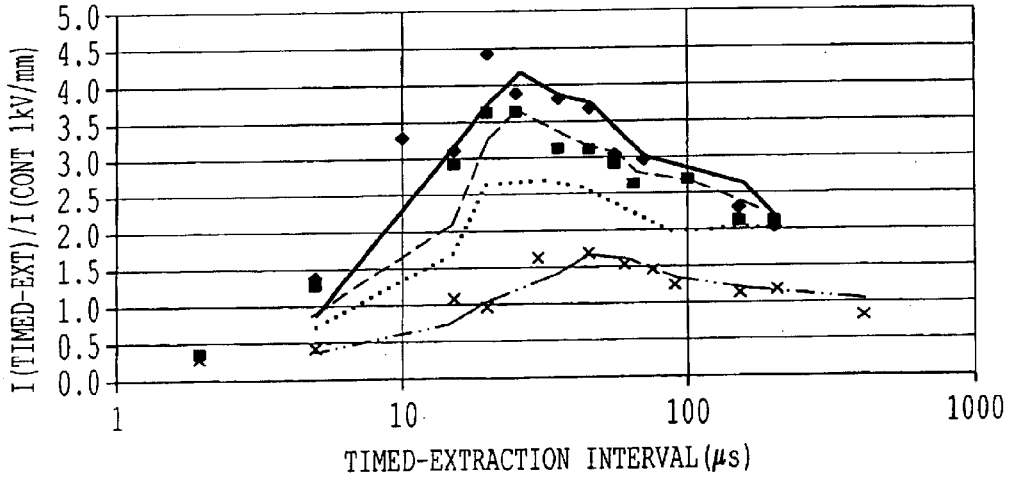
Figure 6C:
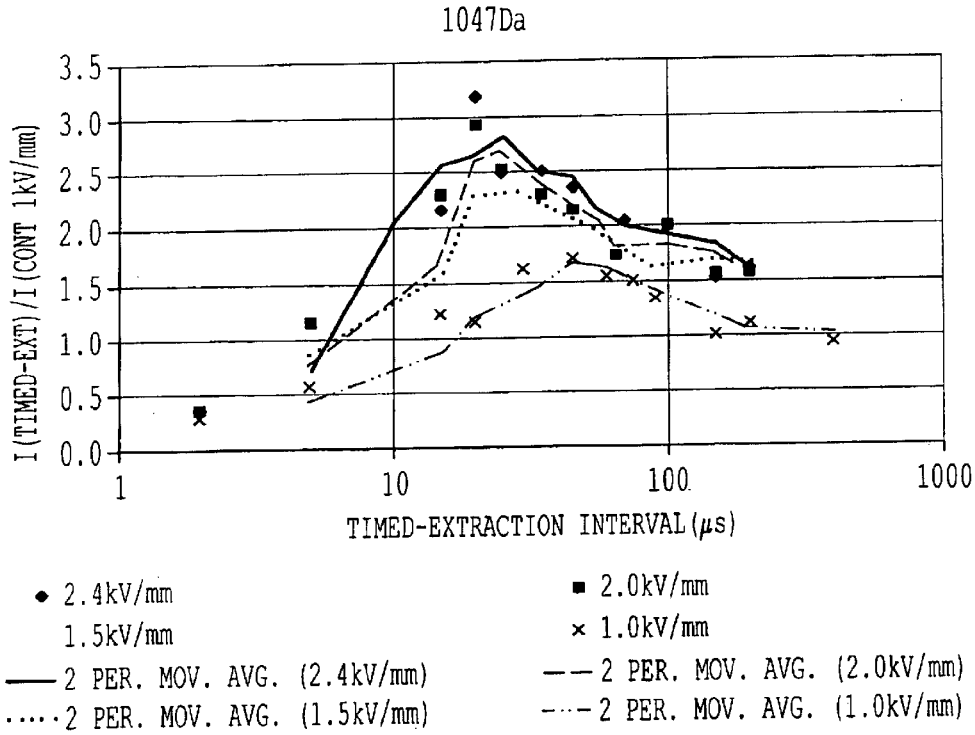

In past applications of AP/MALDI, described for example in Doroshenko et al. in Int J Mass Spectrom (vol 221, pp. 39–58, 2002), the entire contents of which are incorporated herein by reference, an optimal electric field for continuous extraction ranged from 1 to 1.25 kV/mm. Comparing timed-extraction and the continuous extraction results between 1 and 1.25 kV/mm shows a level of improvement as expected when higher electric fields are applied. Comparing timed extraction results to the continuous extraction results between 1 and 1.25 kV/mm shows that sensitivity for the TIC can be increased, according to the present invention, by more than a factor of 3 (see e.g. FIG. 6A), and for specific peptide peaks the increase can be higher than a factor of 4 (see e.g. FIG. 6B) for the 1534 Da peak region, and a factor of more than 3 for the 1047 Da peak region (see e.g. FIG. 6C).

Figure 7:
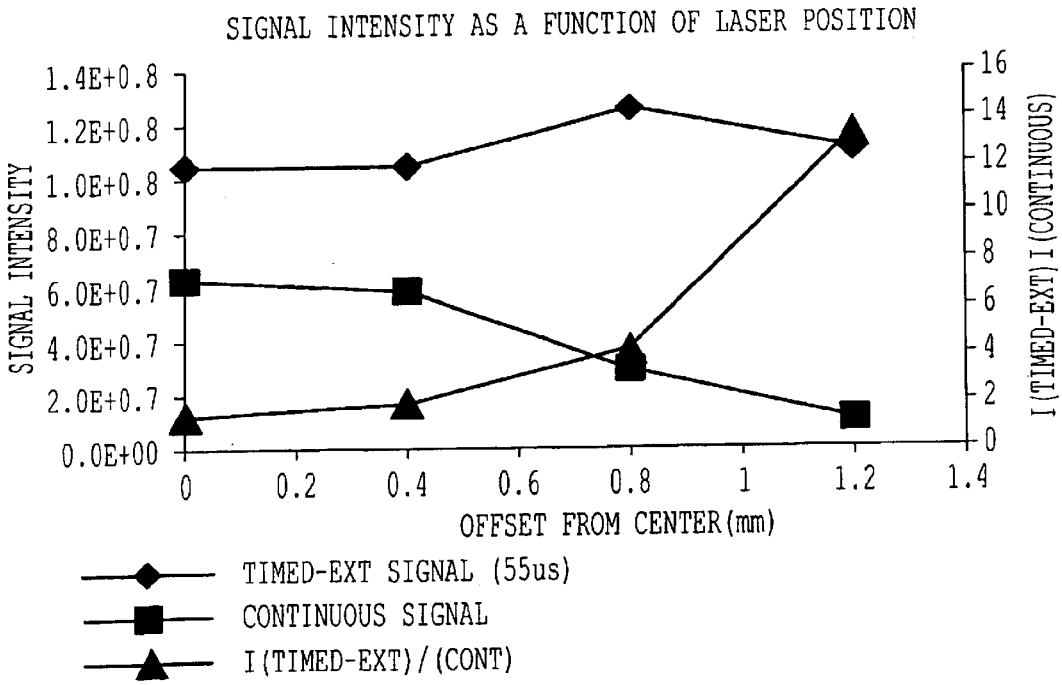
FIG. 7 is schematic illustrating the stability of the ion signal in the present invention for ions generated off-axis from a mass spectrometer capillary entrance.

The results depicted in FIGS. 5A–C and 6A–C are for alignment of the pulsed laser directly on-axis (i.e. aligned in front of the capillary entrance as shown in FIG. 4A). When the MALDI laser position was offset from the central position, the observed signal intensity using the timed-extraction approach of the present invention did not change significantly over an off-set distance of 1.2 mm (see e.g. FIG. 7). In contrast for continuous extraction, the signal intensity, while not changing within a 0.4 mm offset from the on-axis position, dropped significantly when moved from 0.8 to 1.2 mm off-axis. As seen in FIG. 7, timed-extraction of the present invention is more robust with respect to fluctuations in laser position as compared to continuous extraction where more precise alignment is required. For off-axis alignments, the timed-extraction of the present invention improves signal intensity over a continuous extraction by over 13 times.

Hence, one advantage offered by the present invention is the utilization of larger than conventional laser spot sizes to further enhance sensitivity. Here, with the off-axis collection efficiency being high, ions generated by a larger than normal spot size (i.e. a spot size of 2.4 mm for the present invention as compared to a spot size of 0.4 mm conventionally) will not be lost from collection. Accordingly, timed-extraction is less sensitive to laser position than continuous extraction.

Figure 8A:
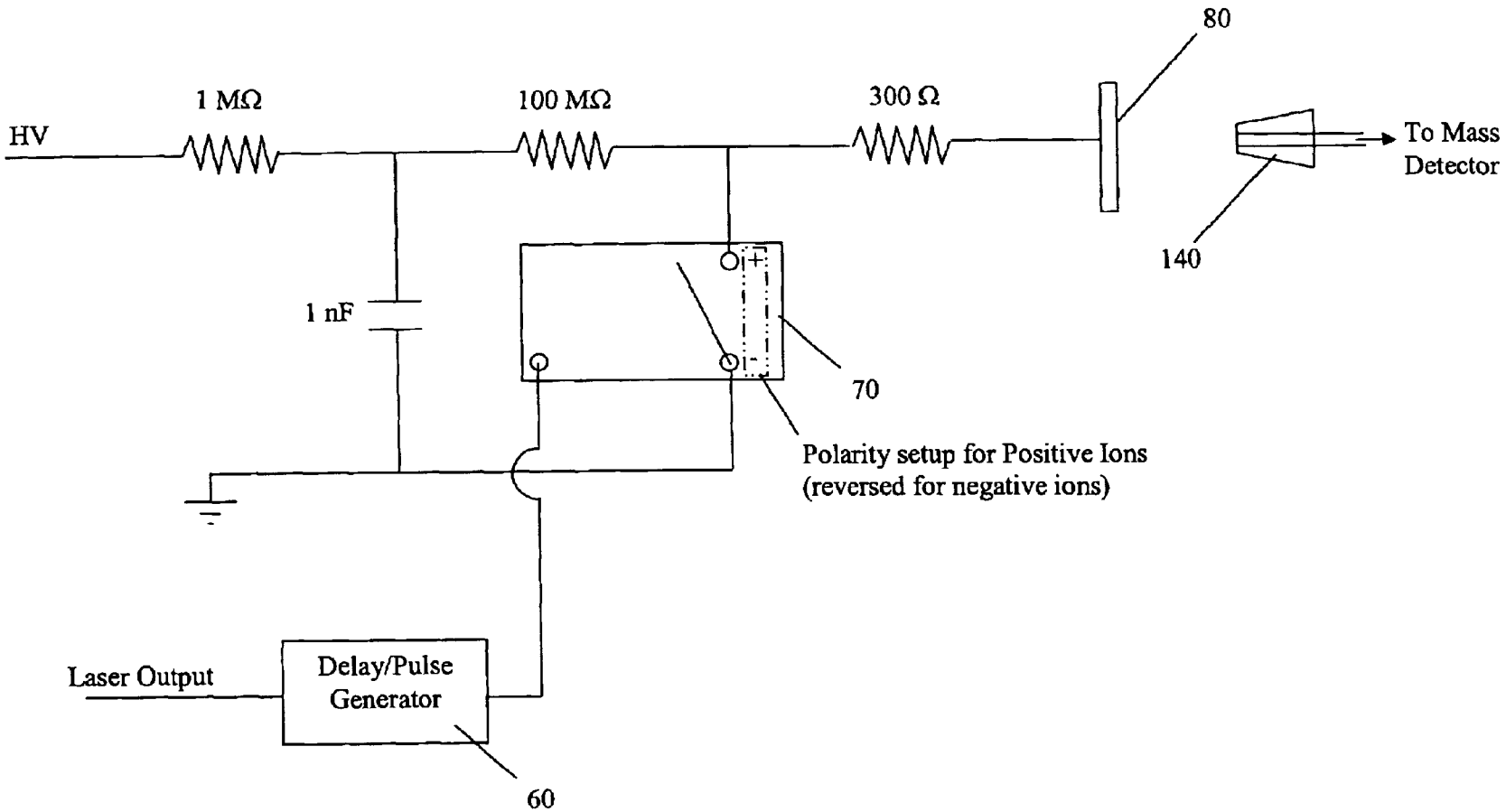
FIG. 8A is an illustrative diagram of a circuit employed in the present invention to produce a transient electric field around a conical entrance of a mass spectrometer.
Figure 8B:
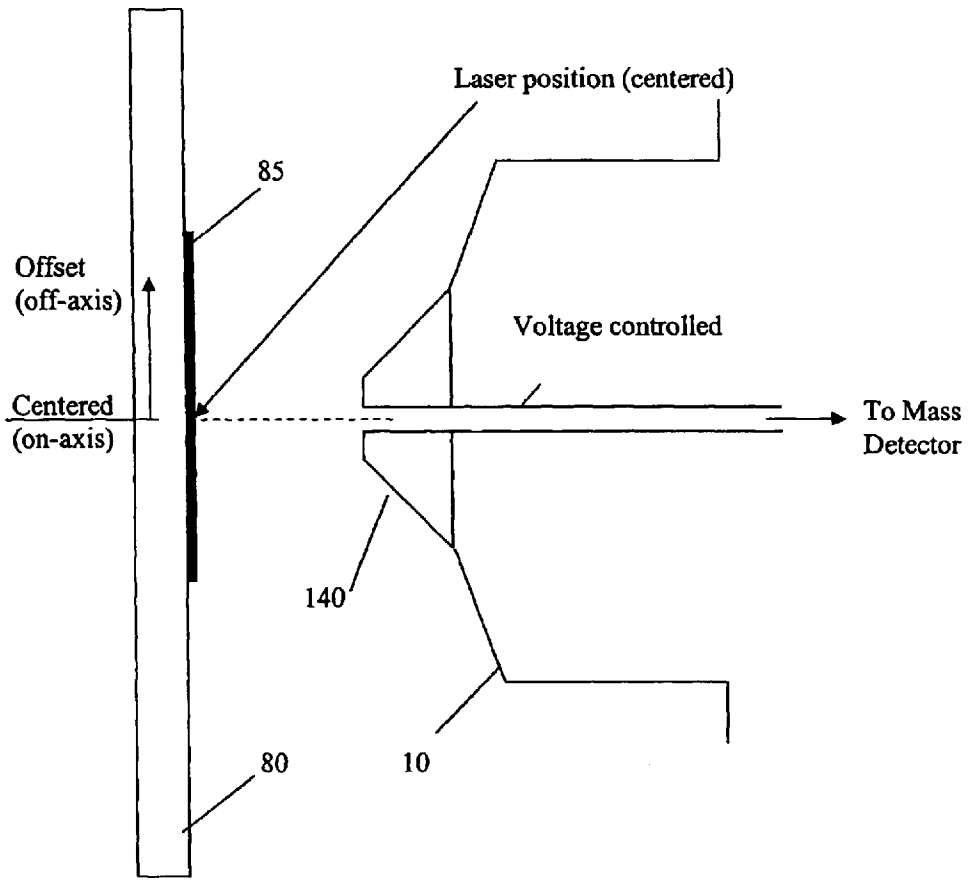
FIG. 8B is a schematic of another embodiment of the present invention applied to a conical entrance of a mass spectrometer.

FIG. 8A is an illustrative diagram of a circuit employed in the present invention for applying a transient electric field to a conical entrance 140 of a mass analyzer 10. In this embodiment, the inlet to the mass spectrometer is maintained at a small voltage controlled by the mass analyzer. The conical entrance 140 as depicted in FIG. 8B can be a skimmer such as those used in atmospheric pressure inlets to mass spectrometers similar to those described in Morris, H. R., et al., Rapid Communications in Mass Spectrometry (vol. 10(8), pp. 889–896, 1996), the entire contents of which are incorporated herein by reference.

Figure 9A:
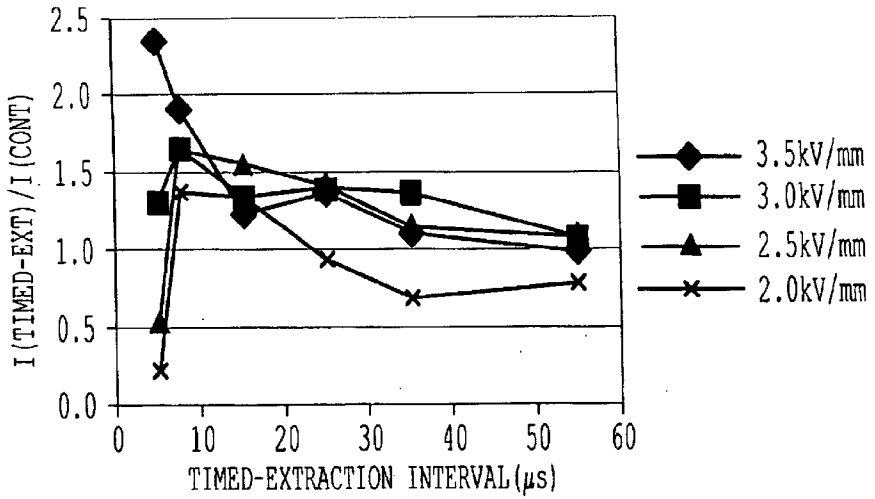
FIGS. 9A–C are schematics illustrating the improvement in ion signal intensity of the present invention as compared to a continuous extraction field, when tested with a conical entrance to a mass spectrometer and 5 peptides at 200 fmol level.
Figure 9B:
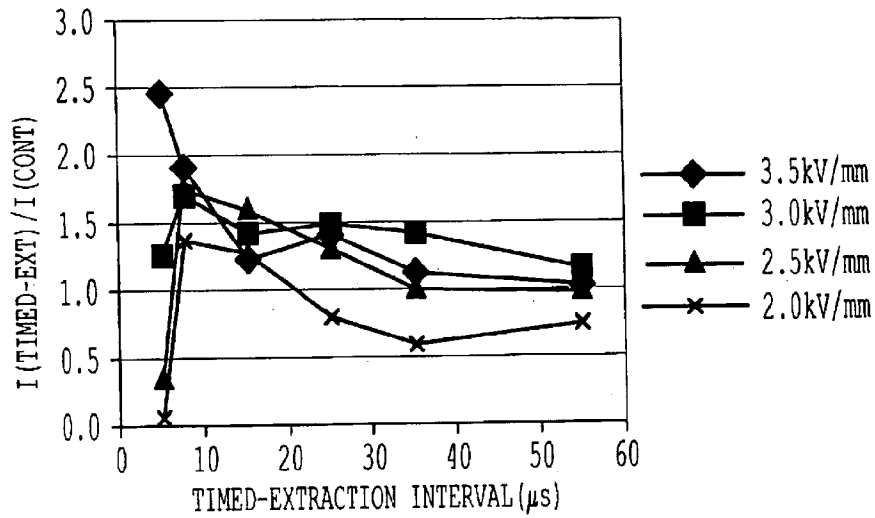
Figure 9C:
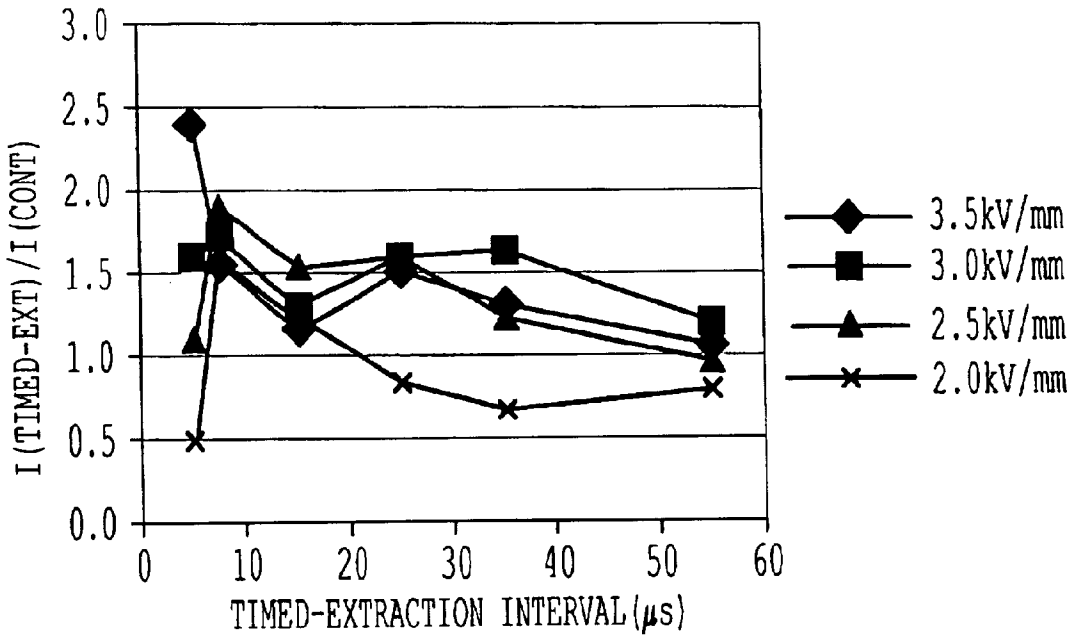

Applying the timed-extraction technique of the present invention to the apparatus shown in FIG. 8B reveals an improvement of more than 2 times in TIC at an electric field strength of 3.5 kV/mm (see e.g. FIGS. 9A–C). The timed-extraction interval for the high voltage applied to the target plate for optimal sensitivity enhancement is approximately 5 $\mu$s. This shorter time period as compared to earlier periods utilized with the apparatus depicted in FIG. 4A may possibly be explained by the difference in the entrance aperture in FIG. 8A from the embodiment described in FIG. 4A. The difference in intake airflows for the two mass spectrometers utilized as well as the shorter 1.0 mm target plate to mass analyzer entrance distance are factors influencing maximization of the TIC.

Figure 10A:
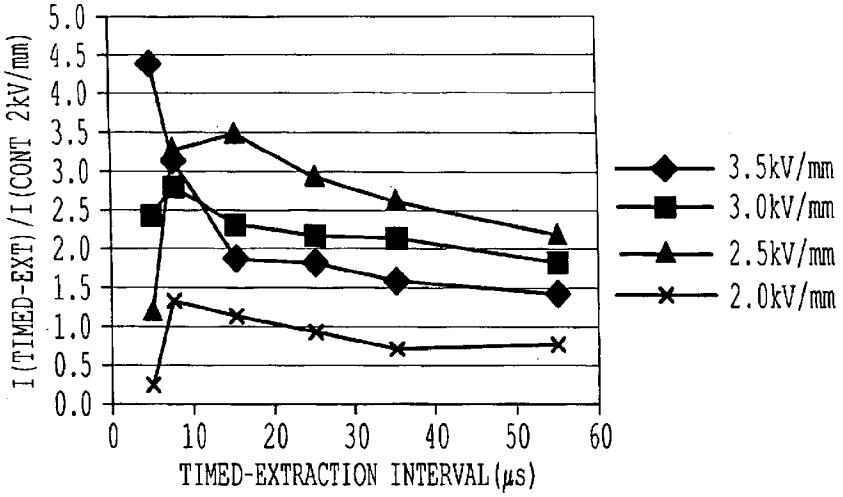
FIGS. 10A–C are schematics illustrating the improvement in ion signal intensity of the present invention as compared to a continuous extraction field operated at a typical 2 kV/mm, when tested with a conical entrance to a mass spectrometer.
Figure 10B:
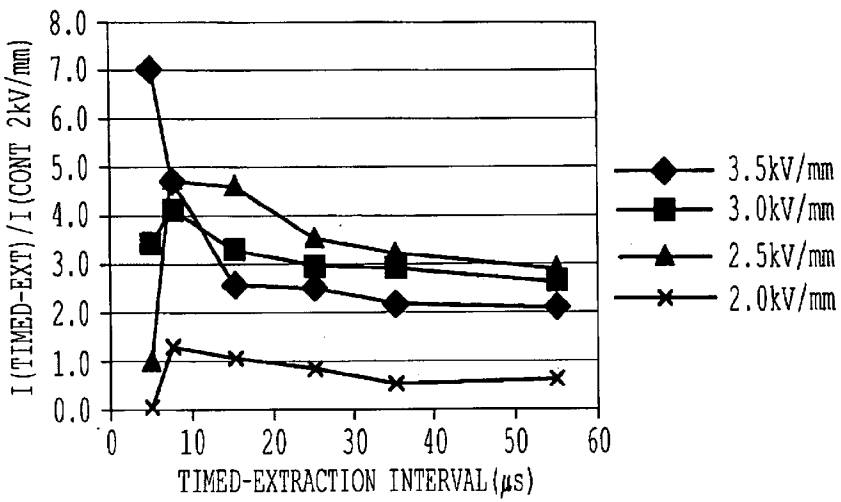
Figure 10C:
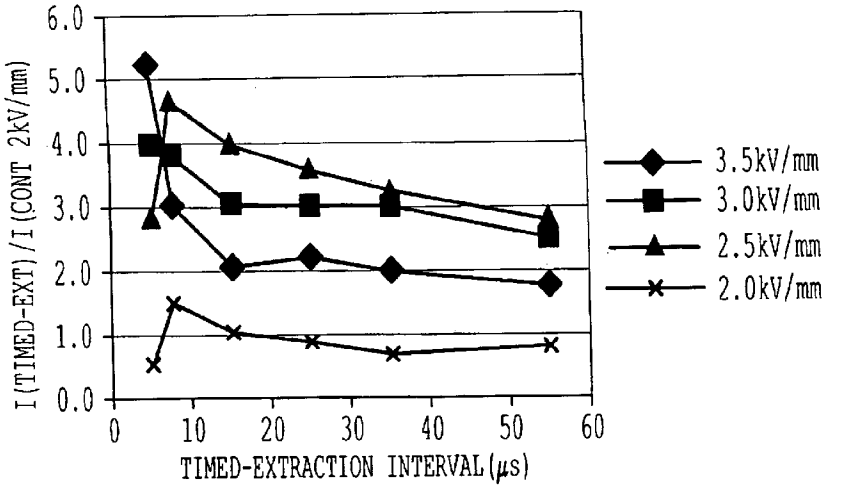
Figure 11A:
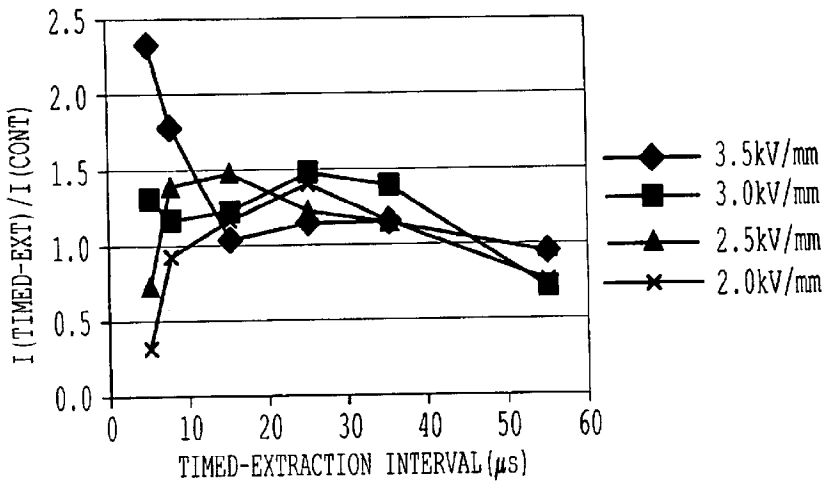
FIGS. 11A–C are schematics illustrating the improvement in ion signal intensity of the present invention as compared to a continuous extraction field, when tested with a conical entrance to a mass spectrometer and 5 peptides at 20 fmol level.
Figure 11B:
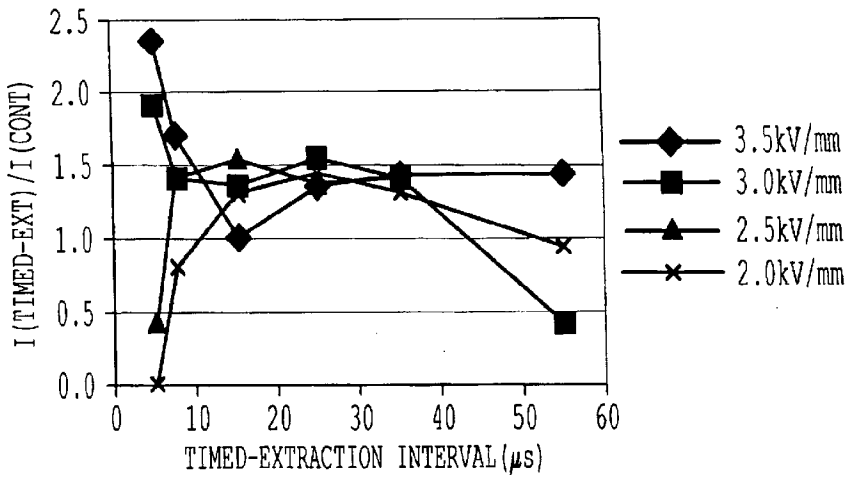
Figure 11C:
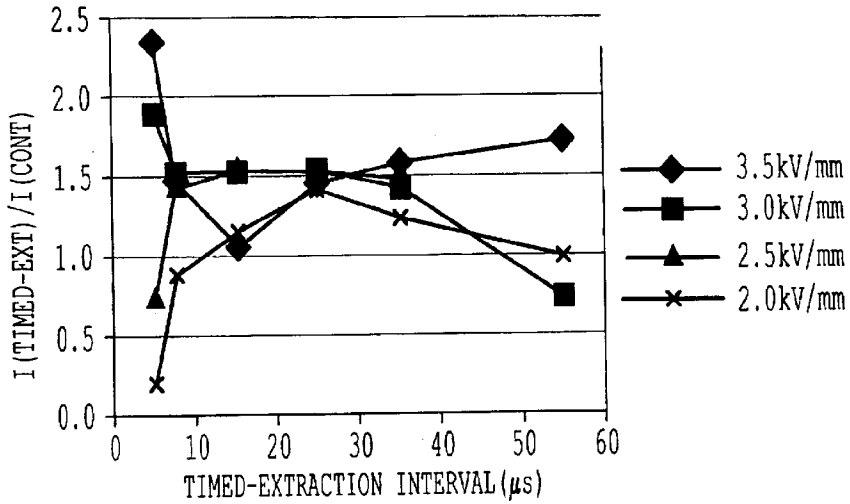

Comparing the timed-extraction approach for the apparatus depicted in FIG. 8A to a 2 kV/mm continuous extraction setting shows that improvements in sensitivity of the present invention can be more than 4 times for the TIC (see e.g. FIG. 10A), and more than 5 times for specific peptide peak regions (see e.g. FIGS. 10B–C). When tests were performed on the same peptide standards but at a 20 fmol level (prepared using 2 $\mu$L spots and 10 fmol/$\mu$L peptide concentration) (FIGS. 11A–C), virtually the same responses as for 200 fmol (FIG. 9) were found.

Figure 12:
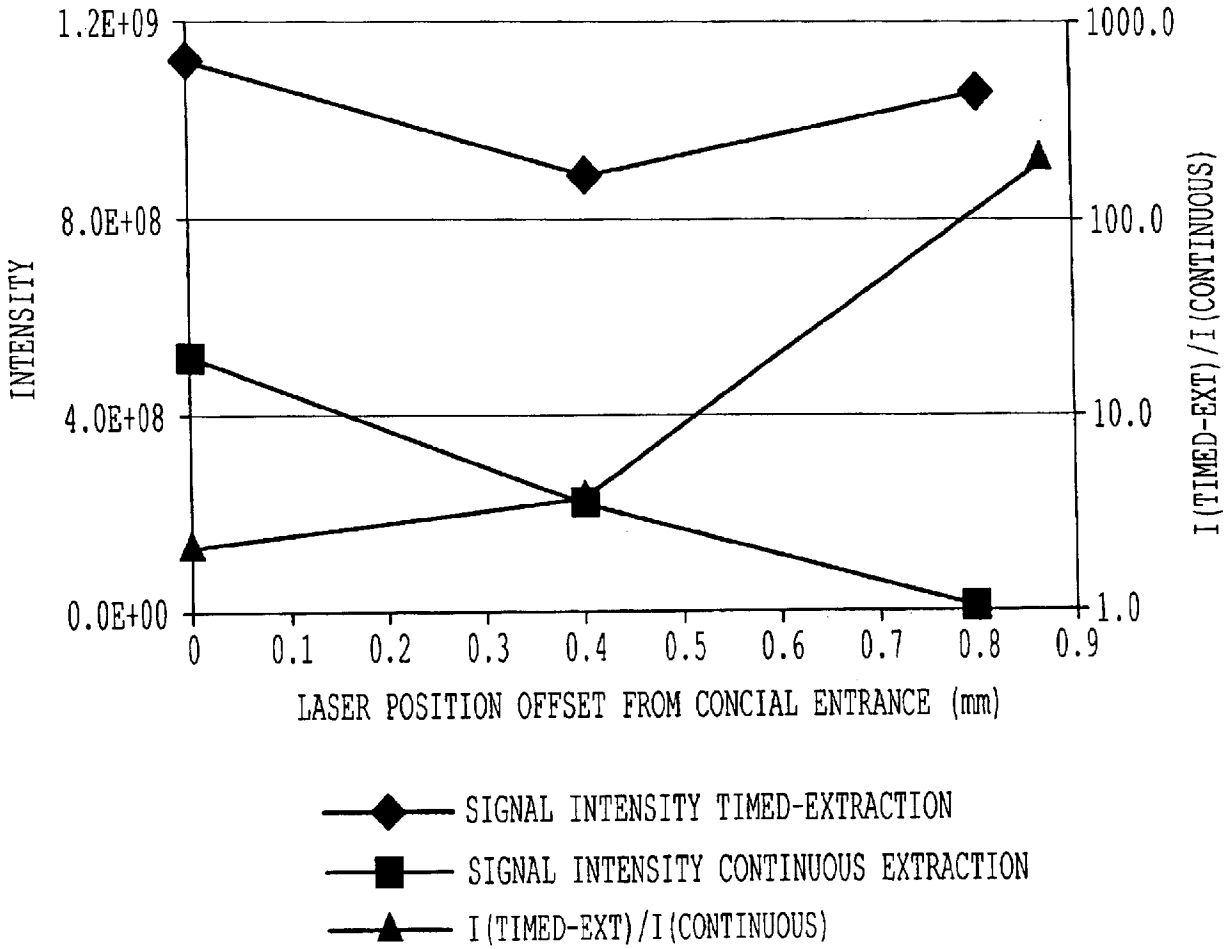
FIG. 12 is a schematic illustrating the stability of the ion signal in the present invention for ions generated off-axis from the mass spectrometer conical entrance.

Analysis of the signal intensity as a function of distance from the central axis of the conical entrance is shown in FIG. 12. With the conical entrance embodiment, once again the signal is stable for a 0.8 mm offset using the timed-extraction technique of the present invention. On the other hand, for a continuous extraction mode, the signal intensity drops immediately once the laser irradiation deviates off-axis by as little as 0.4 mm. The relative ion signal improvement using the timed extraction of the present invention to a mass spectrometer having a conical entrance is more than 5 and 100 times at off-axis positions of 0.4 mm and 0.8 mm, respectively.

Figure 8C:
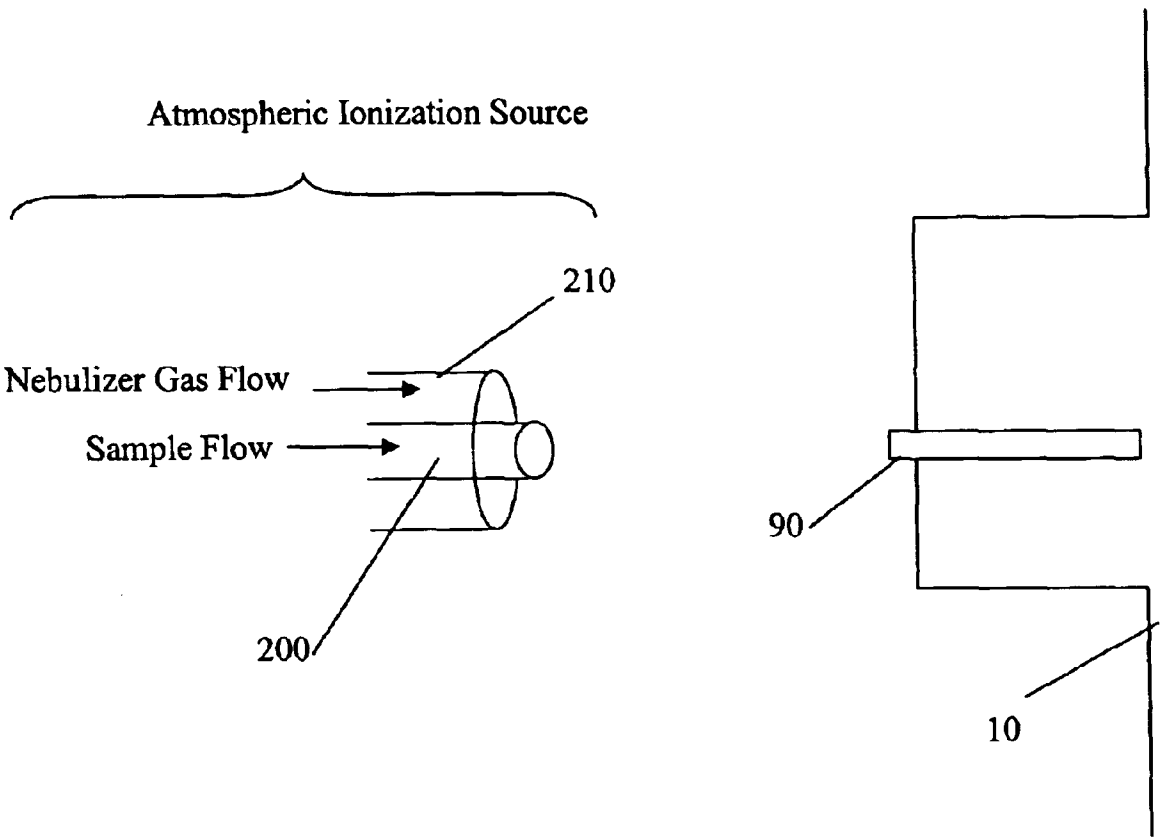
FIG. 8C is a schematic of another embodiment of the present invention utilizing a general atmospheric ionization technique.

Besides AP-MALDI sources, other atmospheric pressure sources can be used according to the present invention. FIG. 8C is a schematic of another embodiment of the present invention utilizing a general atmospheric ionization technique. Atmospheric ionization techniques such as electrospray ionization and chemical ionization are disclosed in U.S. Pat. No. 5,756,994, the entire contents of which are incorporated herein by reference. Thus, one atmospheric ionization source suitable for the present invention is an electrospray ionization source. In electrospray ionization, ions are formed by nebulizing small droplets exiting a central injection tube 200 by a nebulizing gas stream exiting an outer cylindrical tube 210 shown in FIG. 5C. As the small droplets (containing a solvent) evaporate, the droplets become highly charged until the droplets break apart into small gas-phase, multiply-charged ions. The charged liquid droplets are sprayed through a region having a transient high electric field potential as compared to the entrance of the mass analyzer, as shown in FIG. 8C. The transient high electric field potential is used, according to the present invention, to drift ions to the entrance of a mass analyzer.

Furthermore, another atmospheric ionization source suitable for the present invention is an atmospheric pressure ionization source. In atmospheric pressure ionization, a corona discharge provides a source of electrons by which gas flowing from for example the injection tube 200 can be ionized. Once again, a transient high electric field potential is used, according to the present invention, to drift ions to the entrance of a mass analyzer.

Further, the electrical field configuration resulting from the structural arrangement shown in FIG. 8C can be seen as an electric field lens (i.e. a focusing device) in that the electric field lines originating from the injection tube 200 terminate on the grounded mass analyzer entrance 90. Ions generated drift along these field lines to the mass analyzer entrance 90. Other lens configurations can be used such as for example the afore-mentioned "funnel" field.

Figure 8D:
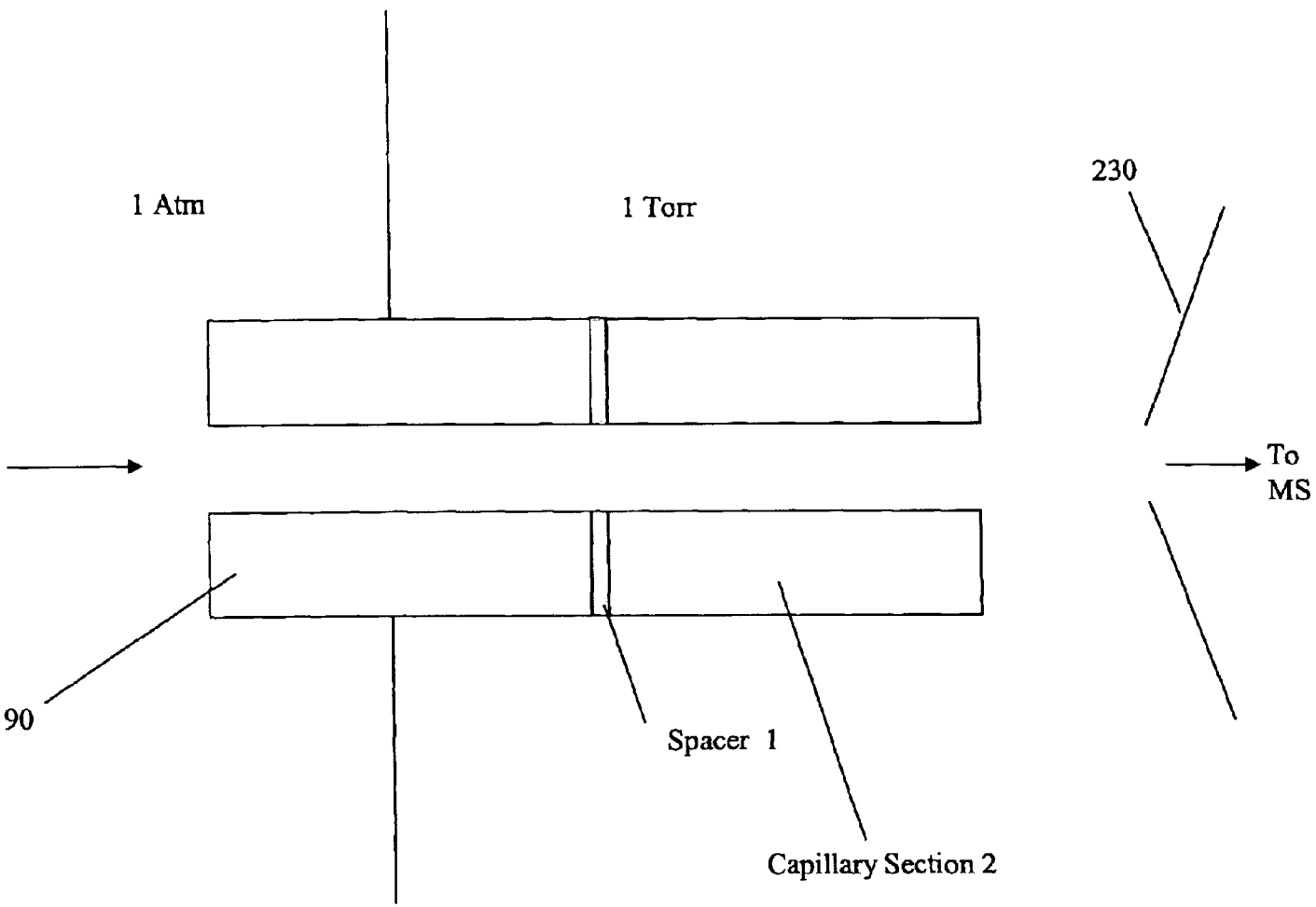
FIG. 8D is a schematic illustrating the application of the present invention internal to a mass analyzer.

Besides improvements in ion collection from atmospheric pressure ion sources, ion collection in intermediate pressure regions (e.g., pressure regions about 1 Torr) between an entrance capillary 90 and a skimmer 230 depicted in FIG. 8D also experience ion losses under a mechanism similar to that described for the entrance aperture at atmospheric pressure. Consequently, according to the present invention and as shown in FIG. 8D, a transient electric field device (illustrated in FIG. 8D by the capillary section 2 having a transient electric field potential and proximate to a grounded internal gas skimmer 230) may also be applied advantageously to reduce ion loss at the intermediate pressures inside the mass spectrometer. The capillary section 2 is isolated from the entrance capillary 90 by an insulating spacer 1.

Furthermore, the present invention is applicable to mass analyzers receiving either positive or negative ions. The present invention is applicable to a variety of gas-assisted ionization methods, where for example gas could flow in the direction of drift of ions, as in AP-MALDI, V. Laiko et al. Anal. Chem. (vol. 72, pp. 652–657, 2000), the entire contents of which are incorporated herein by reference, or could flow as used in other ionization sources in an opposite direction to the ion drift, as in electrospray ionization sources such as the one described by John Fenn et al. in Science (vol. 246, pp. 64–71, 1989), the entire contents of which are incorporated herein by reference.

It should be understood that the preferred embodiments described herein were provided as illustrative of the principles of the present invention. It will be apparent to those skilled in the art that many variations, including but not limited to, different laser energies, fluences, and positions, different pressures, different plate-to-entrance distances, different ion sources, different HV electric fields, different electrodynamic schemes, and different mass analyzers may be utilized without departing from the present invention.

Figure 13:
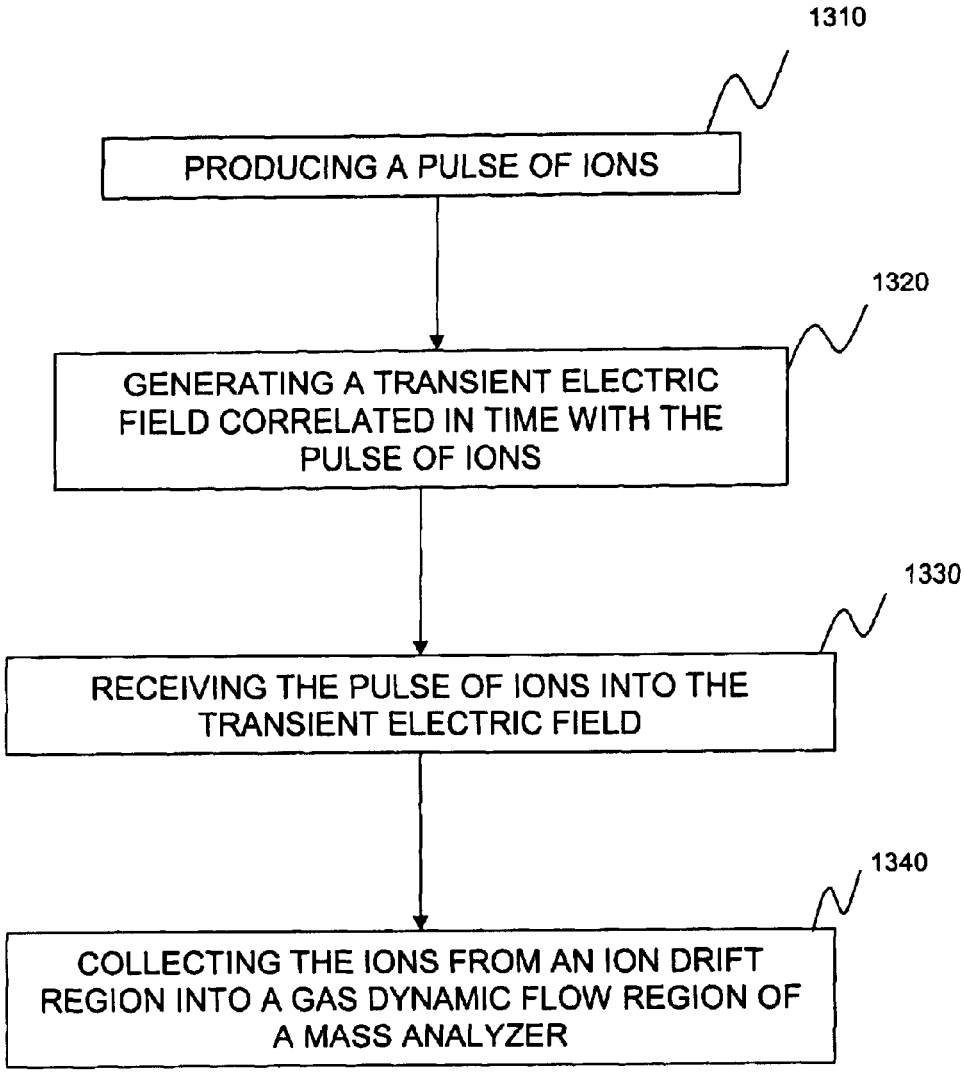
FIG. 13 is a flow chart depicting a method of the present invention.

Thus, in general, the present invention includes apparatus and methods for transferring ions into a mass analyzer. The apparatus and methods of the present invention follow the illustrative steps depicted in FIG. 13. At step 1310, a pulse of ions is produced. According to the present invention, the ions can be produced by generating the ions at or near atmospheric pressure, at pressures above 1 Torr, or at pressures above 100 mTorr. The ions can be produced using laser desorption/ionization, such as for example AP-MALDI. Due to the efficacy of the present invention to collect ions from off-axis positions, laser beams used in laser desorption/ionization can have a diameter of one to six times an entrance diameter of the mass analyzer and/or can be offset from an entrance axis of the mass analyzer by a distance of one to six times the entrance diameter. Furthermore, ion pulses can be produced by spraying charged liquid droplets through a pulsed electric field potential region. Moreover, ions regardless of the source, according to the present invention, are directed to the entrance of the mass analyzer with the applied transient electric field potential acting as a focusing device to thereby collect ions from a continuous ion source. Accordingly, the present invention can produce a pulse of ions from continuous laser ionization, chemical ionization, and electrospray ionization sources.

At step 1320, a transient electric field is generated correlated in time with a duration of the pulse of ions. The ions drift in an ion drift region established by the transient electric field to the mass analyzer. Generation of the transient electric field, at step 1320, can occur by switching between a first electric field potential and a second electric field potential, wherein one of the first and second field potentials is equal to or about zero. Generation of the transient electric field, at step 1320, can pulse the transient electric field prior to producing the pulse of ions and/or pulse the transient electric field after producing the pulse of ions. At step 1320, the transient electric field can have a duration at least as long in duration as the pulse of ions. Alternatively, the transient electric field can have a duration shorter than the duration of the pulse of ions. The transient electric field can be terminated after the pulse of ions. The transient electric field can be variable in time.

At step 1330, ions are received into the transient electric field.

At step 1340, ions are collected from an ion drift region of the transient electric field into a gas dynamic flow region of the mass analyzer. According to the present invention, ion collection entrains the ions in a gas flowing from a high pressure region to a low pressure region. For example, ions can be entrained in a gas flow (i.e., in a gas dynamic flow region) entering a capillary tube connecting a high pressure region outside the mass analyzer to a low pressure region inside the mass analyzer. The capillary tube can be a segmented tube. At step 1330, separate voltages can be applied to each capillary tube segment for example by applying a transient voltage to produce a pulse of ions or can be applied to each capillary segment to supplement ion collection inside the mass analyzer. Further, ions generated from continuous sources can be directed toward an entrance orifice of the mass analyzer using at least one electric field lens having an applied pulsing focusing potential. In such manner, ions produced from pulsed ion sources (or from continuous ion sources initially) are efficiently collected into the mass analyzer.

Once the ions are collected, the mass analyzer of the present invention employs techniques well known in the art for mass detection, such as for example ion trap mass spectrometers, rf quadrupole mass spectrometers, magnetic sector mass spectrometers, and time-of-flight mass spectrometers to discriminate one ion from another. The present invention improves the ion collection efficiency and thereby improves the resultant signal-to-noise ratios of the mass analyzers and/or improves the utilization of the sample.

Numerous modifications and variations of the present invention are possible in light of the above teachings. It is therefore to be understood that within the scope of the appended claims, the invention may be practiced otherwise than as specifically described herein.

What is claimed is:

1. A method of transferring ions into a mass analyzer having an entrance aperture, comprising the steps of:

producing a pulse of ions having a duration in time;

generating a transient electric field correlated in time with said pulse duration to drift said ions toward said aperture;

receiving said pulse of ions into the transient electric field;

reducing said transient electric field as said pulse of ions approaches said aperture; and collecting said ions from an ion drift region of the transient electric field into a gas dynamic flow region of said entrance aperture.

2. The method of claim 1, wherein said reducing said transient electric field terminates said electric field as said pulse of ions arrives at an entrance to the mass analyzer.

3. The method of claim 1, wherein said reducing said transient electric field terminates said electric field before said pulse of ions are neutralized on an entrance to the mass analyzer.

4. The method of claim 1, wherein said generating a transient electric field comprises:

switching between a first electric field potential and a second electric field potential.

5. The method of claim 4, wherein said switching switches between one of said first and second field potentials which is equal to or about zero.

6. The method of claim 1, wherein said generating a transient electric field comprises:

switching the transient electric field on prior to said producing step.

7. The method of claim 1, wherein said generating a transient electric field comprises:

switching the transient electric field on after said producing step.

8. The method of claim 1, wherein said generating a transient electric field comprises:

generating said transient electric field for at least as long as said pulse duration of said pulse of ions.

9. The method of claim 1, wherein said generating a transient electric field comprises:

generating said transient electric field for a shorter duration than said pulse duration of said pulse of ions.

10. The method of claim 1, wherein said generating a transient electric field comprises:

switching said transient electric field on during said pulse of ions.

11. The method of claim 1, wherein said generating a transient electric field comprises:

generating an electric field pulse which is variable in time.

12. The method of claim 1, wherein said collecting said ions comprises:

entraining said ions in a gas stream entering an entrance orifice in a wall of the mass analyzer.

13. The method of claim 12, wherein said entraining said ions in a gas stream comprises:

entraining said ions in an entrance orifice of a capillary of the mass analyzer.

14. The method of claim 13, wherein said entraining said ions in a gas stream comprises:

entraining said ions in a heated capillary.

15. The method of claim 12, wherein said entraining said ions in a gas stream comprises:

entraining said ions in a vertex of a skimmer.

16. The method of claim 12, wherein said entraining said ions in a gas stream comprises:

supplying an additional flow of gas into said ion drift region to supplement ion collection.

17. The method of claim 1, wherein the producing a pulse of ions comprises:

generating said ions at or near atmospheric pressure.

18. The method of claim 1, wherein the producing a pulse of ions comprises:

generating said ions at pressures above 1 Torr.

19. The method of claim 1, wherein the producing a pulse of ions comprises:

generating said ions at pressures above 100 mTorr.

20. The method of claim 1, wherein the producing a pulse of ions comprises:

generating said ions using a laser desorption/ionization technique.

21. The method of claim 20, wherein the generating said ions using a laser desorption/ionization technique comprises:

ionizing a sample with a laser beam having a diameter of one to six times an entrance diameter of said mass analyzer.

22. The method of claim 20, wherein the generating said ions using a laser desorption/ionization technique comprises:

ionizing a sample with a laser beam offset from an entrance axis of the mass analyzer by a distance of one to six times an entrance diameter of said mass analyzer.

23. The method of claim 1, wherein said collecting comprises:

directing said ions to an entrance of the mass analyzer using a focusing device.

24. The method of claim 1, wherein the producing a pulse of ions comprises:

generating said ions by a chemical ionization technique.

25. The method of claim 24, wherein said generating said ions utilizes an atmospheric pressure corona discharge to generate said ions.

26. The method of claim 1, wherein the producing a pulse of ions comprises:

generating said ions by an electrospray ionization technique.

27. The method of claim 26, wherein the generating said ions comprises:

spraying charged liquid droplets through a region having a high electric field potential as compared to an entrance of the mass analyzer.

28. The method of claim 27, further comprising:

directing said droplets to the entrance of the mass analyzer by an electric field configuration having a transient electric field potential to thereby produce said pulse of ions.

29. The method of claim 1, wherein the collecting comprises:

entraining said ions in a gas flowing from a high pressure region to a low pressure region inside the mass analyzer.

30. The method of claim 29, wherein said entraining comprises:

flowing said gas in a capillary tube connecting said high pressure region to said low pressure region.

31. The method of claim 30, wherein said flowing comprises:

flowing said gas in a segmented capillary tube having at least two tubes.

32. The method of claim 31, further comprising:

applying separate voltages to each capillary tube segment.

33. The method of claim 32, wherein said applying separate voltages produces said pulse of ions.

34. The method of claim 32, wherein said applying separate voltages supplements ion collection inside the mass analyzer.

35. An apparatus for transferring ions into a mass analyzer having an entrance aperture, comprising:

an ion source configured to generate a pulse of ions having a duration in time;

a transient electric field device configured to receive said pulse of ions and generate a transient electric field correlated in time with said pulse duration, said ions drifting in an ion drift region of the transient electric field toward said aperture of the mass analyzer; and an ion collector configured to collect the ions from said ion drift region into a gas dynamic flow region of the entrance aperture and transfer the ions into the mass analyzer, said transient electric field device configured to reduce said transient electric field as said pulse of ions approaches the entrance aperture.

36. The apparatus of claim 35, wherein said transient electric field device is configured to terminate said electric field as said pulse of ions arrives at an entrance to the mass analyzer.

37. The apparatus of claim 35, wherein said transient electric field device is configured to terminate said electric field before said pulse of ions are neutralized on an entrance to the mass analyzer.

38. The apparatus of claim 35, wherein said transient electric field device is configured to switch between a first electric field potential and a second electric field potential.

39. The apparatus of claim 35, wherein one of said first and second electric field potentials is equal to or about zero.

40. The apparatus of claim 35, wherein said transient electric field device is configured to switch the transient electric field on prior to termination of said pulse of ions.

41. The apparatus of claim 35, wherein said transient electric field device is configured to switch the transient electric field on after generation of said pulse of ions.

42. The apparatus of claim 35, wherein said transient electric field device is configured to pulse the transient electric field for at least as long as said pulse duration of said pulse of ions.

43. The apparatus of claim 35, wherein said transient electric field device is configured to pulse the transient electric field for a shorter duration than said pulse duration of said pulse of ions.

44. The apparatus of claim 35, wherein said transient electric field device is configured to generate an electric field pulse variable in time.

45. The apparatus of claim 35, wherein said ion collector comprises:

an entrance orifice to the mass analyzer, said entrance orifice configured in dimension to entrain said ions in a gas stream entering the mass analyzer.

46. The apparatus of claim 45, wherein said entrance orifice comprises a gas skimmer.

47. The apparatus of claim 45, wherein said entrance orifice comprises:

a capillary configured to entrain said ions in said gas stream.

48. The apparatus of claim 47, wherein said capillary comprises a heated capillary.

49. The apparatus of claim 35, wherein said ion source is configured to generate ions at or near atmospheric pressure.

50. The apparatus of claim 35, wherein said ion source is configured to generate ions at pressures above 1 Torr.

51. The apparatus of claim 35, wherein said ion source is configured to generate ions at pressures above 100 mTorr.

52. The apparatus of claim 35, wherein said ion source comprises a laser ionization source.

53. The apparatus of claim 52, wherein said a laser ionization source comprises:

a laser beam having a diameter of one to six times an entrance diameter of said mass analyzer, and configured to ionize a sample to produce said ions.

54. The apparatus of claim 52, wherein said a laser ionization source comprises:

a laser beam offset from an entrance axis of the mass analyzer by a distance of one to six times an entrance diameter of said mass analyzer, and configured to ionize a sample to produce said ions.

55. The apparatus of claim 35, wherein said ion source comprises an electrospray ionization source.

56. The apparatus of claim 55, wherein said electrospray ion source is configured to spray charged liquid droplets through a region having a high electric field potential as compared to the entrance of the mass analyzer.

57. The apparatus of claim 56, wherein said electrospray ion source is configured to direct said droplets to the entrance of the mass analyzer by an electric field configuration having a transient electric field potential to thereby produce said pulse of ions.

58. The apparatus of claim 35, wherein said ion source comprises a chemical ionization source.

59. The apparatus of claim 58, wherein said chemical ionization source includes an atmospheric pressure corona discharge to generate said ions.

60. The apparatus of claim 35, wherein said transient electric field device comprises:

a focusing device configured to direct said ions to an entrance of the mass analyzer.

61. The apparatus of claim 60, wherein said focusing device comprises a lens.

62. The apparatus of claim 35, wherein said ion collector is configured to entrain said ions in a gas flowing from a high pressure region to a low pressure region inside the mass analyzer.

63. The apparatus of claim 62, wherein said ion collector comprises a capillary tube connecting said high pressure region to said low pressure region.

64. The apparatus of claim 63, wherein said capillary tube comprises a segmented capillary tube having at least two tubes.

65. The apparatus of claim 64, further comprising:

an insulated capillary tube interconnecting said at least two tubes.

66. The apparatus of claim 35, wherein the transient electric field device comprises:

a plate positioned apart from the ion collector; and a high voltage switch configured to switch on/off an electric field potential to the plate.

67. The apparatus of claim 66, further comprising:

a delay/pulse generator configured to activate said high voltage switch in association with said pulse of ions.

68. The apparatus of claim 66, wherein said plate includes a sample upon which laser pulse desorption/ionization produces said pulse of ions.

69. The apparatus of claim 35, wherein said ion collector comprises a conical entrance to the mass analyzer.

70. The apparatus of claim 69, wherein the conical entrance comprises a skimmer.

* * * * *